US010395617B2

(12) United States Patent
Abe et al.

(10) Patent No.: US 10,395,617 B2
(45) **Date of Patent: *Aug. 27, 2019**

(54) SHIFT REGISTER CIRCUIT

(71) Applicant: Japan Display Inc., Tokyo (JP)

(72) Inventors: Hiroyuki Abe, Chiba (JP); Masahiro Maki, Mobara (JP); Hideo Sato, Hitachi (JP); Hiroaki Komatsu, Mobara (JP)

(73) Assignee: Japan Display Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/225,094

(22) Filed: Dec. 19, 2018

(65) Prior Publication Data

US 2019/0122629 A1 Apr. 25, 2019

Related U.S. Application Data

(63) Continuation of application No. 16/106,835, filed on Aug. 21, 2018, now Pat. No. 10,199,004, which is a (Continued)

(30) Foreign Application Priority Data

Jan. 25, 2011 (JP) ..... 2011-013512

(51) Int. Cl.
*G09G 3/36* (2006.01)
*G09G 3/00* (2006.01)

(52) U.S. Cl.
CPC ..... *G09G 3/3677* (2013.01); *G09G 3/006* (2013.01); *G09G 3/3611* (2013.01); (Continued)

(58) Field of Classification Search
CPC .... G09G 3/3677; G09G 3/3688; G09G 3/006; G09G 3/3611; G09G 2310/0251; (Continued)

(56) References Cited

U.S. PATENT DOCUMENTS 9,865,215 B2 1/2018 Abe et al.
2007/0290982 A1 12/2007 Kim et al.
(Continued)

FOREIGN PATENT DOCUMENTS

JP 2010-113247 A 5/2010
JP 2010-262296 A 11/2010

*Primary Examiner* — Aneeta Yodichkas
(74) *Attorney, Agent, or Firm* — Michael Best & Friedrich LLP

(57) ABSTRACT

A gate signal line driving circuit includes plural basic circuits, each outputting to a gate signal line a gate signal which is high during a high signal period and low during a low signal period. Each of the basic circuits includes: agate line high voltage application circuit which is turned on in accordance with the high signal period to apply the high voltage to the gate signal line; a gate line low voltage application circuit which is turned on in accordance with the low signal period to apply the low voltage to the gate signal line; and a second gate line low voltage application circuit which is turned on to apply the low voltage to the gate signal line in at least a part of a period between turning off the gate line high voltage application circuit and turning on the gate line low voltage application circuit.

8 Claims, 17 Drawing Sheets

Related U.S. Application Data continuation of application No. 15/830,061, filed on Dec. 4, 2017, now Pat. No. 10,089,949, which is a continuation of application No. 15/361,785, filed on Nov. 28, 2016, now Pat. No. 9,865,215, which is a continuation of application No. 14/805,134, filed on Jul. 21, 2015, now Pat. No. 9,542,897, which is a continuation of application No. 13/356,700, filed on Jan. 24, 2012, now Pat. No. 9,123,274.

(52) U.S. Cl.
CPC ... *G09G 3/3688* (2013.01); *G09G 2310/0248* (2013.01); *G09G 2310/0251* (2013.01); *G09G 2310/0281* (2013.01); *G09G 2310/0283* (2013.01); *G09G 2310/0286* (2013.01); *G09G 2310/0289* (2013.01); *G09G 2310/0297* (2013.01); *G09G 2310/08* (2013.01)

(58) Field of Classification Search
CPC ..... G09G 2310/0281; G09G 2310/08; G09G 2310/0283; G09G 2310/0289; G09G 2310/0297; G09G 2310/0286; G09G 2310/0248
See application file for complete search history.

(56) References Cited

U.S. PATENT DOCUMENTS

| | | | |
|---|---|---|---|
| 2008/0101529 | A1 | 5/2008 | Tobita |
| 2010/0277206 | A1 | 11/2010 | Lee et al. |
| 2011/0157263 | A1 | 6/2011 | Kim et al. |

SHIFT REGISTER CIRCUIT

CROSS-REFERENCE TO RELATED APPLICATIONS

This application is a continuation of U.S. patent application Ser. No. 16/106,835 filed on Aug. 21, 2018, which, in turn, is a continuation of U.S. patent application Ser. No. 15/830,061 (now U.S. Pat. No. 10,089,949) filed on Dec. 4, 2017, which, in turn, is a continuation of U.S. patent application Ser. No. 15/361,785 filed on Nov. 28, 2016 (now U.S. Pat. No. 9,865,215) which, in turn, is a continuation of U.S. patent application Ser. No. 14/805,134 (now U.S. Pat. No. 9,542,897) filed on Jul. 21, 2015, which, in turn, is a continuation of U.S. patent application Ser. No. 13/356,700 (now U.S. Pat. No. 9,123,274) filed on Jan. 24, 2012. Further, this application claims priority from Japanese application JP 2011-013512 filed on Jan. 25, 2011, the entire contents of which are hereby incorporated by reference into this application.

BACKGROUND OF THE INVENTION

1. Field of the Invention

The present invention relates to a gate signal line driving circuit and a display device using the same.

2. Description of the Related Art

In known display devices, such as liquid crystal display devices, a method is often adopted in which agate signal line driving circuit including plural shift register basic circuits, which output to plural gate signal lines gate signals that have a high voltage in order, is formed on the same substrate as a thin film transistor (hereinafter, referred to as a TFT) disposed in a display unit, example. A gate signal line driving circuit in the related art is disclosed in JP 2010-113247A.

For example, in a shift register basic circuit disclosed in JP 2010-113247A, an OFF voltage is applied to a switch of a gate line high voltage application circuit (transistors 93 and 94), which is turned on in a high signal period to apply a high voltage to a gate signal line, after the high signal period by an internal signal of a shift register basic circuit located at the subsequent stage. Accordingly, the gate line high voltage application circuit is turned off.

In addition, the shift register basic circuit provided in the gate signal line driving circuit may further include a gate line low voltage application circuit which is turned on in a low signal period (a period other than the high signal period) to apply a low voltage to the gate signal line so that the low voltage is stably output to the gate signal line during the low signal period. In this case, it is necessary to control a switch of the gate line low voltage application circuit similarly.

In order to do so, a control circuit which controls voltages applied to the switch of the gate line high voltage application circuit and the switch of the gate line low voltage application circuit, respectively, is required, and it is necessary to acquire a control signal for controlling the control circuit from the outside of the shift register basic circuit. This increases the circuit size of the shift register basic circuit.

SUMMARY OF THE INVENTION

The invention has been made in view of such a problem, and it is an object of the invention to provide a gate signal line driving circuit capable of improving the voltage quality of a gate signal output to a gate signal line while suppressing an increase in the circuit size and a display device using the gate signal line driving circuit.

In order to solve the above-described problem, according to a first aspect of the invention, a gate signal line driving circuit includes: plural shift register basic circuits each of which outputs to a corresponding gate signal line a gate signal which has a high voltage during a high signal period of one screen display period and has a low voltage during a low signal period that is a period other than the high signal period. Each of the shift register basic circuits includes: a gate line high voltage application circuit which is turned on in accordance with the high signal period to apply the high voltage to the corresponding gate signal line; a gate line low voltage application circuit which is turned on in accordance with the low signal period to apply the low voltage to the corresponding gate signal line; and a second gate line low voltage application circuit which is turned on to apply the low voltage to the corresponding gate signal line in at least a part of a period until the gate line low voltage application circuit is turned on after the gate line high voltage application circuit is turned off.

According to a second aspect of the invention, in the gate signal line driving circuit according to the first aspect of the invention, a gate signal at a subsequent stage may be input to a switch of the second gate line low voltage application circuit of each of the shift register basic circuits.

According to a third aspect of the invention, in the gate signal line driving circuit according to the first aspect of the invention, each of the shift register basic circuits may further include a high voltage application OFF control circuit which applies an OFF voltage to a switch of the gate line high voltage application circuit in accordance with a timing at which a control voltage applied to a switch of the gate line low voltage application circuit of the shift register basic circuit at a preceding stage changes from OFF voltage to ON voltage.

According to a fourth aspect of the invention, in the gate signal line driving circuit according to the first aspect of the invention, each of the shift register basic circuits may further include a low voltage application ON control circuit which increases a control voltage, which is applied to a switch of the gate line low voltage application circuit, to an ON voltage at a timing at which two-phase clock signals with different phases are input at a predetermined period and one of the two-phase clock signals changes from the low voltage to the high voltage, and the other clock signal of the two-phase clock signals may be input to the gate line high voltage application circuit.

According to a fifth aspect of the invention, in the gate signal line driving circuit according to any one of the first to fourth aspects of the invention, each of the shift register basic circuits may include a high voltage application driving OFF control circuit which applies an OFF voltage to a switch of the gate line high voltage application circuit in an ON state and a low voltage application driving OFF control circuit which applies an OFF voltage to a switch of the gate line low voltage application circuit in an ON state.

According to a sixth aspect of the invention, in the gate signal line driving circuit according to the fifth aspect of the invention, in each of the shift register basic circuits, when the shift register basic circuit is not driven for the switch of the high voltage application driving OFF control circuit and the switch of the low voltage application driving OFF control circuit, an intermediate voltage higher than the low voltage and lower than the high voltage may be applied to turn on the high voltage application driving OFF control circuit and the low voltage application driving OFF control circuit.

According to a seventh aspect of the invention, in the gate signal line driving circuit according to the sixth aspect of the invention, the intermediate voltage may be a ground voltage.

According to an eighth aspect of the invention, in the gate signal line driving circuit according to the fifth aspect of the invention, in each of the shift register basic circuits, the high voltage application driving OFF control circuit and the low voltage application driving OFF control circuit are turned off together in at least a part of a blanking period, for which all voltages of the plural gate signal lines are the low voltage, of one screen display period and are turned on in the other period when the shift register basic circuit is not driven.

According to a ninth aspect of the invention, in the gate signal line driving circuit according to the fifth aspect of the invention, each of the shift register basic circuits may further include a switching control circuit which supplies an ON voltage to the switch of the high voltage application driving OFF control circuit and the switch of the low voltage application driving OFF control circuit.

According to a tenth aspect of the invention, in the gate signal line driving circuit according to the ninth aspect of the invention, an intermediate voltage higher than the low voltage and lower than the high voltage is applied to a switch of the switching control circuit of each of the shift register basic circuits to turn on the switching control circuit.

According to an eleventh aspect of the invention, in the gate signal line driving circuit according to the ninth aspect of the invention, when the shift register basic circuit is not driven, the switching control circuit of each of the shift register basic circuits may supply an OFF voltage in at least a part of a blanking period, for which all voltages of the plural gate signal lines are the low voltage, of one screen display period and supply an ON voltage in the other period.

According to a twelfth aspect of the invention, in the gate signal line driving circuit according to the tenth aspect of the invention, in each of the shift register basic circuits, the high voltage may be input to the switching control circuit when the switching control circuit supplies an ON voltage.

According to a thirteenth aspect of the invention, a display device includes the gate signal line driving circuit according to any one of the first to twelfth aspects of the invention.

According to the aspects of the invention, there are provided a gate signal line driving circuit, which suppresses noise in a gate signal while suppressing an increase in the circuit size, and a display device using the gate signal line driving circuit.

DETAILED DESCRIPTION OF THE INVENTION

[First Embodiment]

Figure 1:
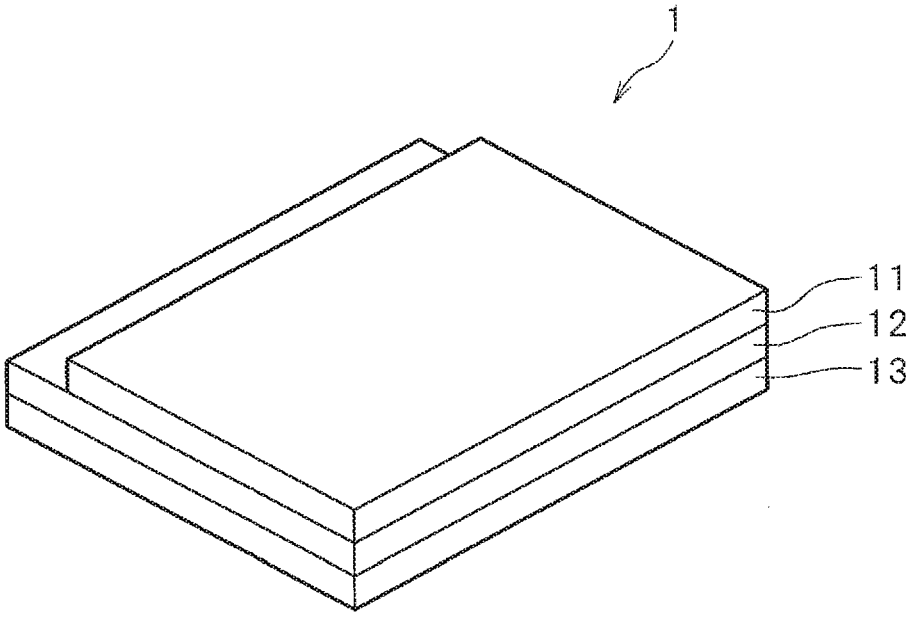
FIG. 1 is an overall perspective view of a liquid crystal display device according to an embodiment of the invention.

A display device according to a first embodiment of the invention is an IPS (In-Plane Switching) liquid crystal display device 1, for example. As shown in an overall perspective view of the liquid crystal display device 1 according to the present embodiment shown in FIG. 1, the liquid crystal display device 1 is configured to include a TFT substrate 12, a filter substrate 11 which faces the TFT substrate 12 and in which a color filter is provided, a liquid crystal material sealed in a region interposed between both the substrates, and a backlight 13 disposed adjacent to a surface of the TFT substrate 12 not facing the filter substrate 11. Here, a gate signal line 105, a video signal line 107, a pixel electrode 110, a common electrode 111, a TFT 109, and the like, which will be described later, are disposed on the TFT substrate 12 (refer to FIG. 3).

Figure 2:
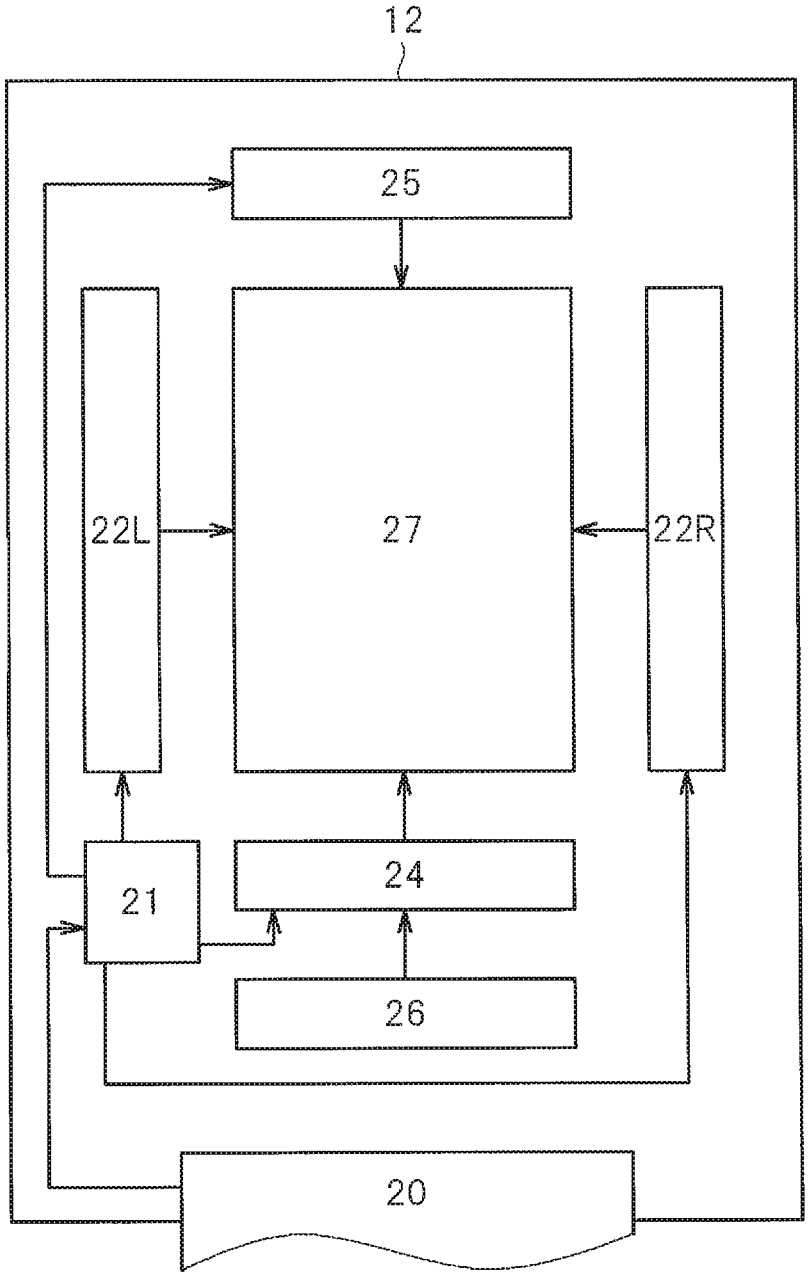
FIG. 2 is a block diagram showing the configuration of a TFT substrate of the liquid crystal display device according to the embodiment of the invention.

FIG. 2 is a block diagram showing the configuration of the TFT substrate 12 of the liquid crystal display device 1 according to the present embodiment. A FPC 20 (flexible printed circuit) is connected to the TFT substrate 12 by pressure bonding, and control signals are input to the TFT substrate 12 from the outside through the FPC 20.

A display unit 27, a driver IC 21, a gate signal line driving circuit 22, an RGB selection circuit 24, a precharge circuit 25, and a detection circuit 26 are provided on the TFT substrate 12. The gate signal line driving circuit 22 is disposed at each of both sides of the display unit 27. In FIG. 2, a gate signal line driving circuit 22R disposed at the right side of the display unit 27 and a gate signal line driving circuit 22L disposed at the left side of the display unit 27 are shown. Control signals output from the driver IC 21 are input to the gate signal line driving circuit 22.

Figure 3:
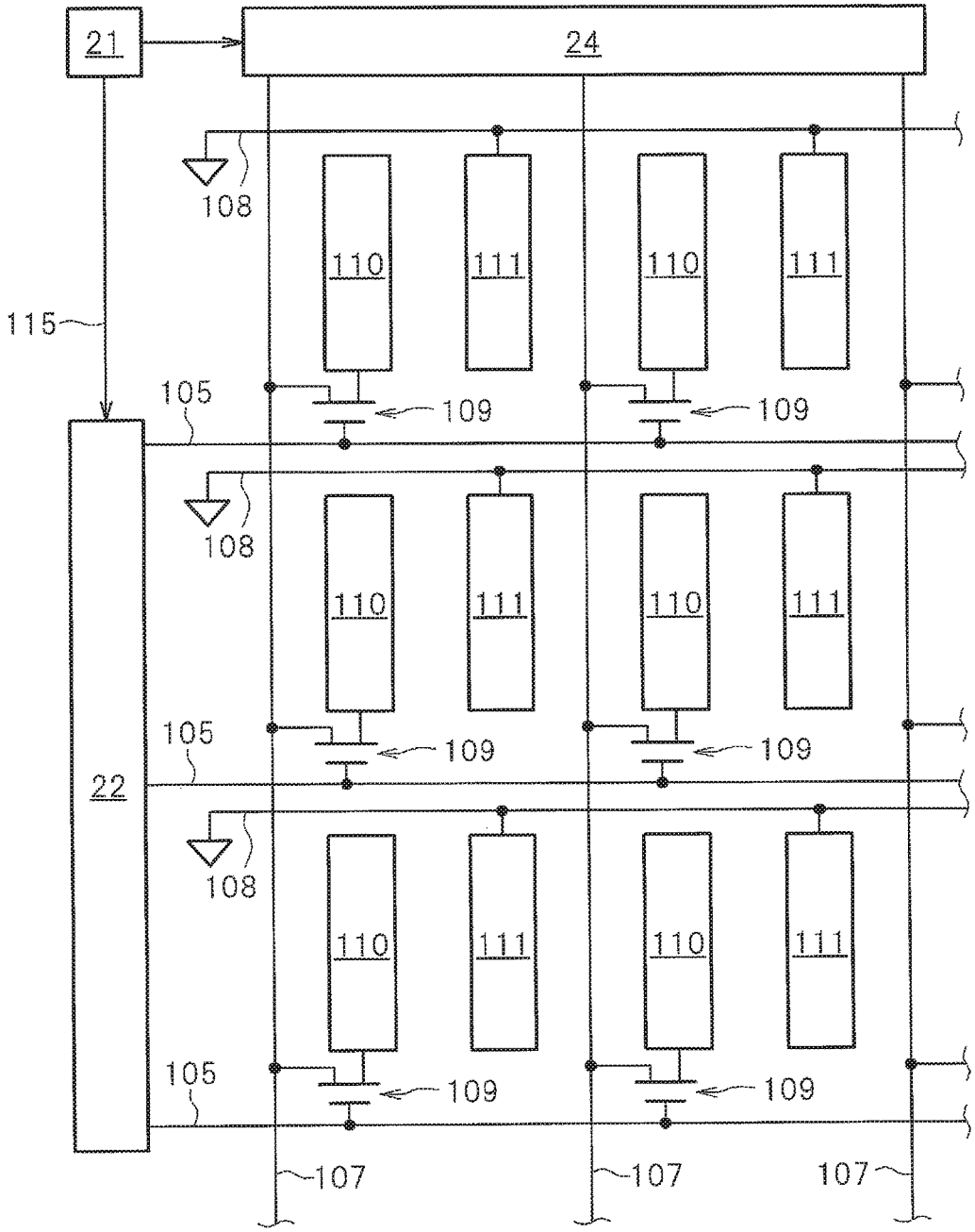
FIG. 3 is a conceptual view of an equivalent circuit of main parts of the TFT substrate according to the embodiment of the invention.

FIG. 3 is a conceptual view of an equivalent circuit of main parts of the TFT substrate 12 according to the present embodiment. As shown in FIG. 3, on the TFT substrate 12, plural gate signal lines 105 connected to the gate signal line driving circuit 22 extend in a horizontal direction in the drawing at equal distances therebetween.

Plural shift register basic circuits SR are provided in the gate signal line driving circuit 22 so as to correspond to the plural gate signal lines 105. For example, when 854 gate signal lines 105 are present, 854 shift register basic circuits SR are similarly provided in the gate signal line driving circuit 22. According to control signals input from the driver IC 21, each shift register basic circuit SR outputs to the corresponding gate signal line 105 a gate signal which has a high voltage during a corresponding high signal period of 1 frame period $T_F$ (one screen display period), which is a period for which one screen is displayed, and has a low voltage during a low signal period which is the other period in the frame period $T_F$.

In addition, although the driver IC 21 controls the plural shift register basic circuits SR provided in the gate signal line driving circuit 22 with control signals 115 output from the driver IC 21 herein, the control is not limited to this example. For example, a shift register control circuit may be provided in the gate signal line driving circuit 22 and this shift register control circuit may control the plural shift register basic circuits SR according to control signals that are output. In this case, control signals from the outside are input to the shift register control circuit through the FPC 20, and the shift register control circuit generates control signals output to the plural shift register basic circuits SR.

In addition, plural video signal lines 107 connected to the RGB select ion circuit 24 extend in a vertical direction in the drawing at equal distances therebetween. In addition, display dots arrayed in a grid shape are divided by the gate signal lines 105 and the video signal lines 107. In addition, common signal lines 108 extend in the horizontal direction in the drawing so as to be parallel to the corresponding gate signal lines 105, respectively. Alternatively, the common signal lines 108 may extend in the vertical direction in the drawing, similar to the video signal line 107.

A TFT 109 is formed in the corner of each display dot divided by the gate signal lines 105 and the video signal lines 107, and is connected to the video signal line 107 and a pixel electrode 110. In addition, a gate electrode of the TFT 109 is connected to the gate signal line 105. In each display dot, a common electrode 111 is formed so as to face the pixel electrode 110.

In the circuit configuration described above, a reference voltage COM is applied to the common electrode 111 of each display dot through the common signal line 108. In addition, a gate signal is output from the gate signal line driving circuit 22 to the corresponding gate signal line 105, and a voltage of the gate signal is applied to gates of the plural TFTs 109 connected to the gate signal line 105. The plural TFTs 109 to which the high voltage of the gate signal is applied are in an ON state, and the voltage of a video signal supplied from the driver IC 21 to the corresponding video signal line 107 through the RGB selection circuit 24 is applied to the corresponding pixel electrode 110 through the TFT 109 in the ON state. In addition, an operation of supplying the voltage of a video signal to the pixel electrode 110 is referred to as "writing video data in a display dot". Then, a potential difference occurs between the pixel electrode 110 and the common electrode 111, and this controls the orientation of liquid crystal molecules and the like. Accordingly, the degree of blocking light from the backlight 13 is controlled to display an image.

In FIG. 3, for the simplicity of explanation, the gate signal line driving circuit 22 is shown only at the left side of the display unit 27. In practice, however, the gate signal line driving circuit 22 is disposed at both sides of the display unit 27.

Figure 4:
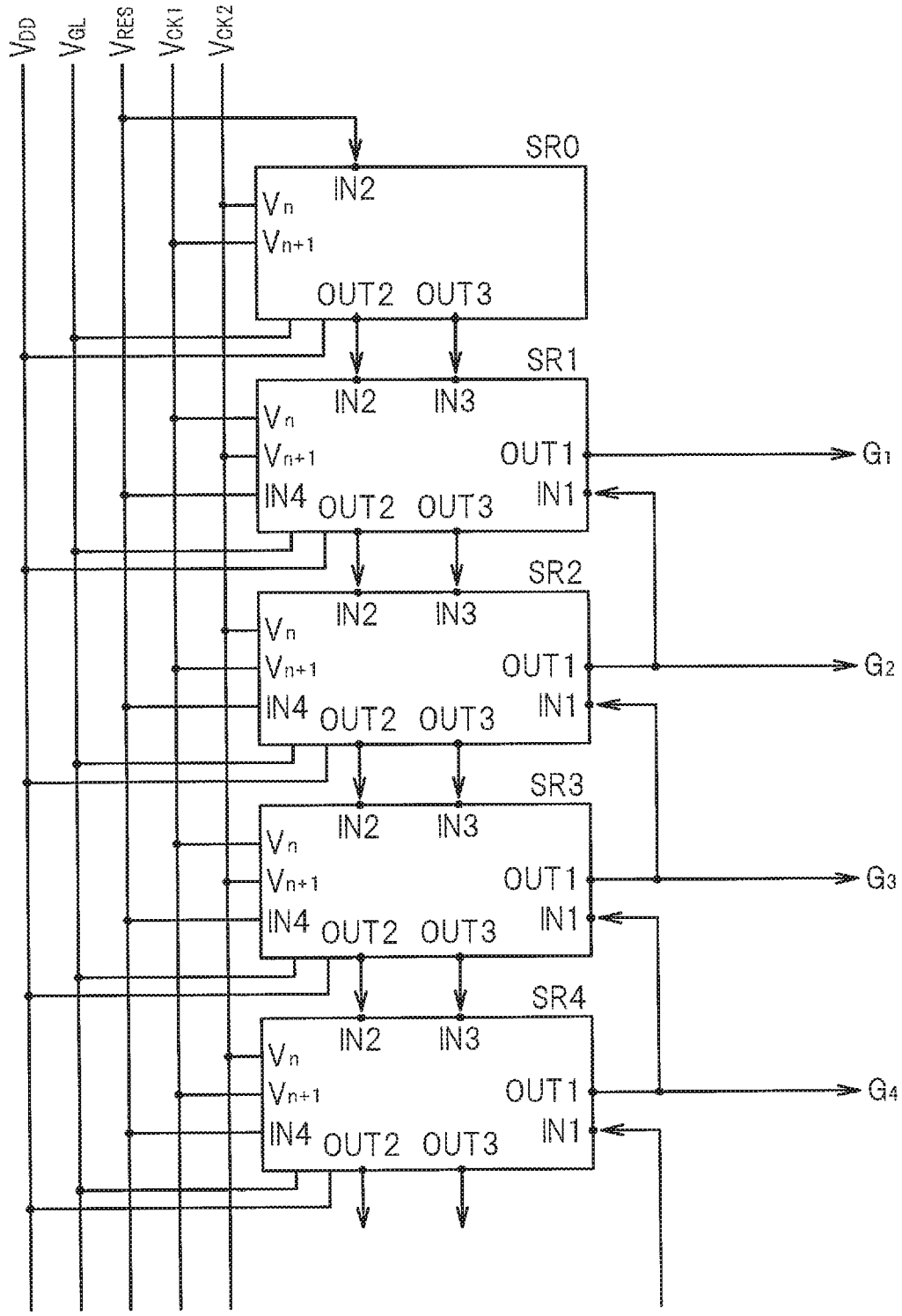
FIG. 4 is a block diagram of plural shift register basic circuits provided in a gate signal line driving circuit according to a first embodiment of the invention.

FIG. 4 is a block diagram of the plural shift register basic circuits SR provided in the gate signal line driving circuit 22 according to the present embodiment. In FIG. 4, one dummy circuit $SR_0$ and four shift register basic circuit SR are shown. In practice, however, the gate signal line driving circuit 22 is formed by the gate signal line driving circuits 22R and 22L provided at both sides of the display unit 27, for example. Each of the gate signal line driving circuits 22R and 22L has a dummy circuit and 854 shift register basic circuits SR, and each shift register basic circuit SR outputs a gate signal to the corresponding gate signal line 105. Here, plural shift register basic circuits SR which perform forward driving, which will be described later, is shown. A first shift register basic circuit $SR_1$, a second shift register basic circuit $SR_2$, and a third shift register basic circuit $SR_3$, are shown in order from the top. In general, an n-th shift register basic circuit is expressed as $SR_n$.

In the gate signal line driving circuit 22 according to the present embodiment, the first to 854-th shift register basic circuits SR output to the corresponding gate signal lines 105 gate signals which have a high voltage in order from the top in 1 frame period $T_F$. That is, a first gate signal $G_1$, a second gate signal $G_2$, a third gate signal $G_3$, and an 854-th gate signal $G_{854}$ continue a high signal period, for which they have a high voltage in this order, in the 1 frame period $T_F$. Assuming that this is forward driving, the gate signal line driving circuit 22 according to the present embodiment can perform forward driving.

As shown in FIG. 2, the gate signal line driving circuit 22R is disposed at the right side of the display unit 27 and the gate signal line driving circuit 22L is disposed at the left side of the display unit 27. Accordingly, both the gate signal line driving circuits 22R and 22L can perform only forward driving. Therefore, both the 854 shift register basic circuits SR provided in the gate signal line driving circuit 22R and the 854 shift register basic circuits SR provided in the gate signal line driving circuit 22L perform forward driving, so that the n-th shift register basic circuits SR provided in the shift register basic circuits SR output to the display unit 27 the same gate signal $G_n$ which has a high voltage during the same high signal period. Since the gate signal line driving circuits 22R and 22L are disposed at both sides of the display unit 27, the load on each shift register basic circuit SR can be reduced to the half. In addition, when the load on each shift register basic circuit SR is not a problem, it is preferable to dispose the gate signal line driving circuit 22 only at one side of the display unit 27.

The control signals 115 input from the driver IC 21 to the gate signal line driving circuit 22 include two-phase clock signals $V_{CK1}$ and $V_{CK2}$, a low voltage power line $V_{GL}$, a buffered voltage power line $V_{DD}$, and a start signal $V_{RES}$ as a trigger of one screen (frame) display.

Here, m-phase clock signals will be described generally. The m-phase clock signals are clock signals with different phases at predetermined periods T. Assuming that the period of a clock signal is T, one period T can be subdivided into periods of T/m in the case of m-phase clock signals. Assuming that the period of T/m is one clock, one period T has m clocks. The m-phase clock signals are set to have a high voltage in order. Assuming that a certain clock is a first clock, a clock signal which changes to have a high voltage at the first clock is set as a clock signal $V_{CK1}$. The clock signal $V_{CK1}$ changes to have a high voltage at the first clock, but has a low voltage at other clocks. In a period of the certain 1 period T, clock signals $V_{CK1}$, $V_{CK2}$, $V_{CK3}$, and $V_{CKm}$ have high voltages in order at first, second, third, and m-th clocks, respectively. Here, a period for which two adjacent clock signals have a low voltage may be present in a period for which either of the two adjacent clock signals has a high voltage. That is, one clock for which a certain clock signal has a high voltage, may include a period for which the clock signal has a low voltage in part. In addition, a low voltage of each clock signal is set to the same voltage as the low voltage power line $V_{GL}$, and a high voltage of each clock signal is set to the same voltage as a high voltage power line $V_{GH}$ (not shown).

Next, input terminals and output terminals of each shift register basic circuit SR will be described. The n-th shift register basic circuit $SR_n$ has four input terminals IN1, IN2, IN3, and IN4 and three output terminals OUT1, OUT2, and OUT3. In addition, one of the two-phase clock signals $V_{CK1}$ and $V_{CK2}$ input to the n-th shift register basic circuit $SR_n$ is expressed as $V_n$, and the other one is expressed as $V_{n+1}$. Generally, "$V_{n+m}=V_n=V_{n-m}$" is satisfied when m-phase clock signals are input. Therefore, in the gate signal line driving circuit 22 according to the present embodiment, "$V_{n+2}=V_n=V_{n-2}$, $V_{n+1}=V_{n-1}$" is satisfied since the two-phase (m=2) clock signals $V_{CK1}$ and $V_{CK2}$ are input.

A gate signal Gn is output from the output terminal OUT1 of the n-th shift register basic circuit $SR_n$, a node $NB_n$ to be described later is output from the output terminal OUT2, and a node $NC_n$ to be described later is output from the output terminal OUT3. The output terminal OUT1 is connected to the corresponding gate signal line 105. In addition, an (n+1)-th gate signal $G_{n+1}$ output from the (n+1)-th shift register basic circuit $SR_{n+1}$ is input to the input terminal IN1 of the n-th shift register basic circuit $SR_n$, nodes $NB_{n-1}$ and $NC_{n-1}$ respectively output from the output terminals OUT2 and OUT3 of the (n−1)-th shift register basic circuit $SR_{n-1}$ are respectively input to the two input terminals IN2 and IN3, and the start signal $V_{RES}$ is input to the input terminal IN4.

In general, for the n-th shift register basic circuit $SR_n$, in order of the forward direction among the plural shift register basic circuits SR which output high-voltage gate signals, the preceding shift register basic circuit SR indicates an (n−1)-th shift register basic circuit $SR_{n-1}$ and the subsequent shift register basic circuit SR indicates an (n+1)-th shift register basic circuit $SR_{n+1}$.

The clock signal $V_{CK1}$ is input to the Vn of the odd-numbered shift register basic circuit SR, and the clock signal $V_{CK2}$ is input to the $V_{n+1}$. On the other hand, the clock signal $V_{CK2}$ is input to the $V_n$ of the even-numbered shift register basic circuit SR, and the clock signal $V_{CK1}$ is input to the $V_{n+1}$. That is, $V_n$ is the clock signal $V_{CK1}$ and $V_{n+1}$ is the clock signal $V_{CK2}$ when n is an odd number, and $V_n$ is the clock signal $V_{CK2}$ and $V_{n+1}$ is the clock signal $V_{CK1}$ when n is an even number.

In addition, the dummy circuit $SR_0$ is disposed before the first shift register basic circuit $SR_1$. The start signal $V_{RES}$ is input to the input terminal IN2 of the dummy circuit $SR_0$. The input terminals IN1, IN3, and IN4 and the output terminal OUT1 do not necessarily need to be provided in the dummy circuit $SR_0$, and may be omitted.

Figure 5:
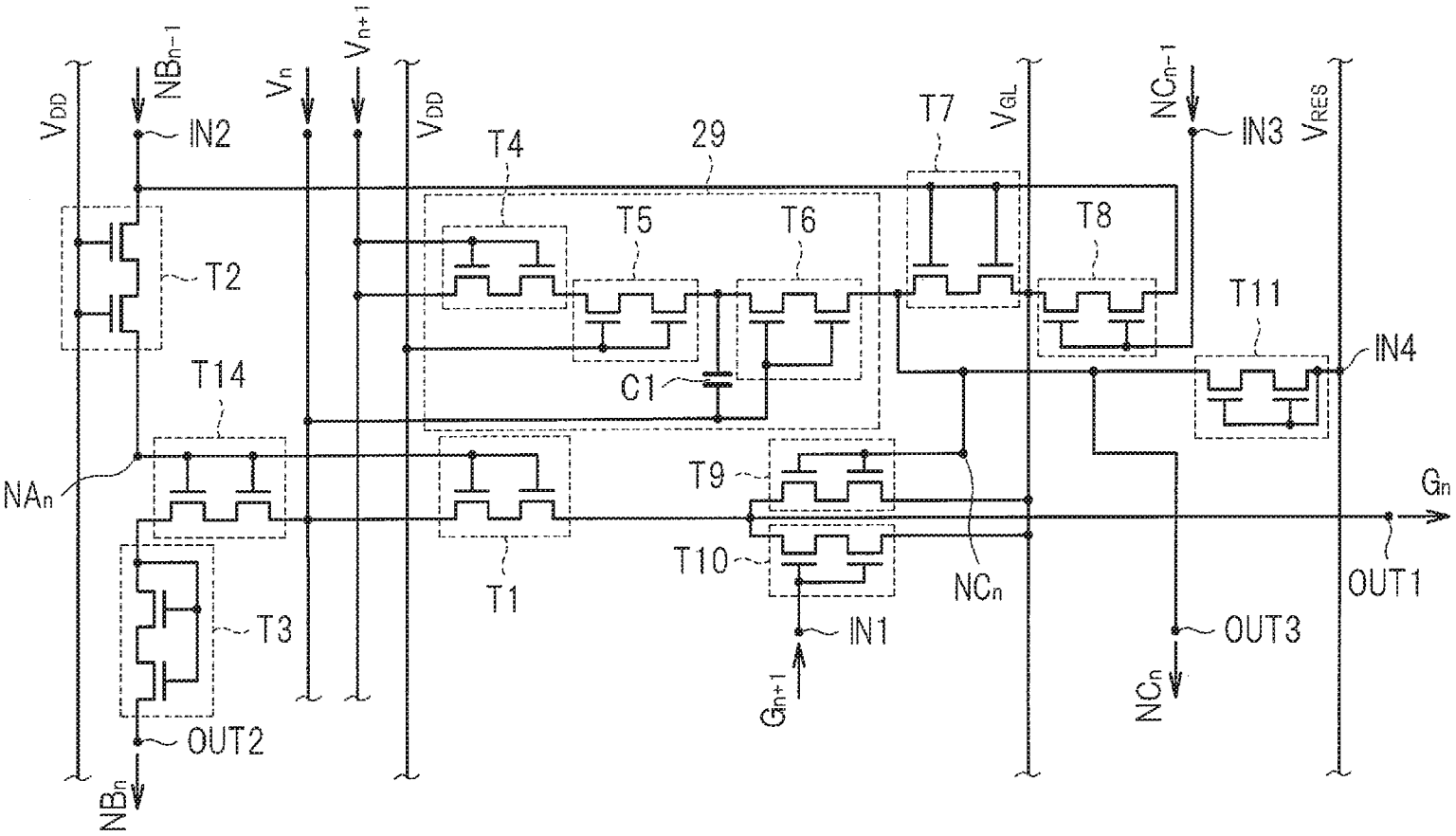
FIG. 5 is a circuit diagram of an n-th shift register basic circuit of the gate signal line driving circuit according to the first embodiment of the invention.

FIG. 5 is a circuit diagram of the n-th shift register basic circuit $SR_n$ of the gate signal line driving circuit 22 according to the present embodiment.

As shown in FIG. 5, a voltage applied to a switch (gate) of a gate line high voltage application circuit (transistor T1) is a node NA, a signal voltage output from a next stage control signal output circuit (transistors T14 and T3) is a node NB, and a voltage (control voltage) applied to a switch (gate) of a gate line low voltage application circuit (transistor T9) is a node NC. Here, in order to show the nodes NA, NB, and NC of the n-th shift register basic circuit $SR_n$ clearly, they are expressed as nodes $NA_n$, $NB_n$, and $NC_n$ in FIG. 5.

In addition, transistors shown in FIG. 5 are n-type TFTs, and a semiconductor material used for the transistors is low-temperature polysilicon (hereinafter, referred to as LTPS). The LTPS is formed by dissolving an amorphous silicon film, which is formed on the substrate, at low temperature of about 100 to 600° C. and then crystallizing the amorphous silicon film, for example. The mobility of the LTPS is about 10 to 600 $cm^2/Vs$. The source-drain breakdown voltage of a transistor using the LTPS is relatively low. For this reason, there is a problem in that when the transistor is in an OFF state, a leakage current flows between the source and the drain. In order to suppress the leakage current in the OFF state, two transistors connected in series are used as the transistor according to the present embodiment. However, the transistor is not limited to two transistors connected in series, and one transistor may also be used when the source-drain breakdown voltage of each transistor is sufficiently larger than a used voltage. On the contrary, three or more transistors connected in series may also be used when the source-drain breakdown voltage of each transistor is sufficiently smaller than the used voltage, or other structures may be adopted. In addition, although the LTPS is used as a semiconductor material for transistors herein, it is needless to say that the semiconductor material is not limited to the LTPS.

The n-type TFT is turned on when the gate potential becomes higher than the source potential by a voltage more than a threshold voltage $V_{TH}$. The voltage which turns on the n-type TFT is an ON voltage. Similarly, the voltage which turns off the n-type TFT is an OFF voltage. In addition, although the transistor according to the present embodiment is described as an n-type TFT herein, the invention may also be applied to a p-type TFT. However, the p-type TFT is turned on when the gate potential becomes lower than the source potential by a voltage more than the threshold voltage $V_{TH}$. This voltage may be called an ON voltage, and the voltage which turns off the p-type TFT may be called an OFF voltage similarly.

The invention is characterized in that the shift register basic circuit SR includes a second gate line low voltage application circuit (transistor T10) which outputs a low voltage to the output terminal OUT1 in an ON state. In the n-th shift register basic circuit $SR_n$, the gate line high voltage application circuit (transistor T1) applies a high voltage to the output terminal OUT1 during a high signal period. Then, in at least a part of a period until the gate line low voltage application circuit (transistor T9) is turned on after the gate line high voltage application circuit is turned off, the second gate line low voltage application circuit is in an ON state and applies a low voltage to the output terminal OUT1. Accordingly, since a low voltage is stably applied to the output terminal OUT1 during a period for which the second gate line low voltage application circuit is in an ON state, the n-th shift register basic circuit $SR_n$ can output the gate signal $G_n$ with higher quality.

Next, the circuit configuration of the n-th shift register basic circuit $SR_n$ of the gate signal line driving circuit 22 according to the present embodiment shown in FIG. 5 will be described.

A transistor T1 is a gate line high voltage application circuit. The clock signal $V_n$ which is one of the two-phase clock signals $V_{CK1}$ and $V_{CK3}$ is input to the input side of the transistor T1, and the output terminal OUT1 is connected to the output side of the transistor T1. The voltage applied to the gate of the transistor T1 is the node $NA_n$. During the high signal period, the node $NA_n$ is an ON voltage. When the node $NA_n$ is an ON voltage, the transistor T1 is in an ON state. Accordingly, the transistor T1 applies the input clock signal $V_n$ to the output terminal OUT1. Since the clock signal $V_n$ has a high voltage during the high signal period, the gate signal $G_n$ output from the output terminal OUT1 has a high voltage during the high signal period.

A transistor T2 is a voltage buffer circuit, and serves to buffer a rapid voltage change. A buffered voltage which is a voltage of the buffered voltage power line $V_{DD}$ is applied to the gate of the transistor T2. Here, the buffered voltage is a voltage between a high voltage and a low voltage, and is a sufficient voltage for turning on a transistor compared with the low voltage. For example, when the high voltage is +10 V and the low voltage is −7V, an appropriate voltage higher than −7 V and lower than +10 V is preferably selected as the buffered voltage. For example, the buffered voltage is +5 V. In addition, if a ground voltage GND (=0 V) is set as the buffered voltage, it is possible to reduce the power consumption since a voltage source is not required in particular.

The transistor T2 is disposed between the input terminal IN2 and the node $NA_n$. Here, for the sake of convenience, it is assumed that the input side of the transistor T2 is connected to the input terminal IN2 and the output side of the transistor T2 is connected to the node $NA_n$. Accordingly, when the node $NA_n$ is a low voltage, the transistor T2 is turned on by the buffered voltage. When a higher voltage than the buffered voltage is input to the input terminal IN2, the transistor T2 drops the higher voltage so that the buffered voltage is applied to the node $NA_n$. That is, the ON voltage of the node $NA_n$ is as high as the buffered voltage. Moreover, the node $NA_n$ may have a higher voltage than the normal ON voltage due to the bootstrap effect, as will be described later. In this case, however, the transistor T2 suppresses "the voltage of the input terminal IN2 becomes higher than the buffered voltage".

An output side of a transistor T8 is connected to the input side of the transistor T2 in parallel with respect to the input terminal IN2. The transistor T8 is a high voltage application OFF control circuit. The low voltage power line $V_{GL}$ is connected to the input side of the transistor T8, and the input terminal IN3 is connected to a gate of the transistor T8. Accordingly, when the ON voltage is applied to the input terminal IN3, the transistor T8 is turned on. Then, the transistor T8 applies a low voltage (OFF voltage) of the low voltage power line $V_{GL}$ to the input side of the transistor T2. In this case, since the transistor T2 is in an ON state by the buffered voltage of the buffered voltage power line $V_{DD}$ applied to the gate of the transistor T2, the transistor T2 applies an OFF voltage to the node $NA_n$. That is, in the ON state, the transistor T8 is a high voltage application OFF control circuit which applies an OFF voltage to the node $NA_n$.

Transistors T14 and T3 are a next stage control signal output circuit. The clock signal $V_n$ is input to the input side of the transistor T14, and the node $NA_n$ is connected to a gate of the transistor T14. The input side and the gate of the transistor T3 are connected to the output side of the transistor T14 as diode connection. The output terminal OUT2 is connected to the output side of the transistor T3. Accordingly, when the node NA becomes an ON voltage, the transistor T14 is turned on, similar to the transistor T1. As a result, the transistor T14 outputs the input clock signal V from the output side. Since the clock signal $V_n$ has a high voltage during a high signal period as described above, the transistor T3 is in an ON state during the high signal period. Accordingly, the transistor T3 applies the high voltage of the clock signal $V_n$ to the output terminal OUT2. In addition, the voltage of the output terminal OUT2 is the node $NB_n$. In addition, since the transistor T3 is diode-connected, the transistor T3 is turned off when the voltage at the output side of the transistor T3 is higher than the voltage at the input side.

A transistor T9 is agate line low voltage application circuit. The low voltage power line $V_{GL}$ is connected to the input side of the transistor T9, and the output terminal OUT1 is connected to the output side of the transistor T9. A voltage applied to a gate of the transistor T9 is the node $NC_n$, and the node NCn is applied to the output terminal OUT3. When the node $NC_n$ is an ON voltage, the transistor T9 is in an ON state. Accordingly, the transistor T9 applies a low voltage of the low voltage power line $V_{GL}$ to the output terminal OUT1.

A transistor T7 is a low voltage application OFF control circuit which applies an OFF voltage to the node NC in the ON state. The low voltage power line $V_{GL}$ is connected to the input side of the transistor T7, the node $NC_n$ is connected to the output side of the transistor T7, and the input terminal IN2 and the output side of the transistor T8 are connected to a gate of the transistor T7. Accordingly, when the input terminal IN2 has a high voltage, the transistor T7 is in an ON state. Then, the transistor T7 applies a low voltage (OFF voltage) of the low voltage power line $V_{GL}$ to the node $NC_n$. In addition, when the transistor T8 is turned on and the low voltage (OFF voltage) is applied to the gate of the transistor T7, the transistor T7 is turned off.

A low voltage application ON control circuit 29 is configured to include transistors T4, T5, and T6 and a capacitor C1, and is a booster circuit which boosts the node NC to the ON voltage.

The input side and the gate of the transistor T4 are connected to the clock signal $V_{n+1}$ as diode connection. The transistor T5 is disposed between the output side of the transistor T4 and the input side of the transistor T6. The transistor T5 is a voltage buffer circuit similar to the transistor T2, and the buffered voltage power line $V_{DD}$ is connected to a gate of the transistor T5. The capacitor C1 is disposed between a gate and the input side of the transistor T6. The clock signal $V_n$ is input to the gate of the transistor T6, and the output side of the transistor T6 is connected to the node $NC_n$. In addition, it is assumed that an upper electrode of the capacitor C1 in FIG. 5 is a first electrode and a lower electrode of the capacitor C1 in FIG. 5 is a second electrode.

When the clock signal $V_n$ has a low voltage and the clock signal $V_{n+1}$ has a high voltage, the transistor T4 is turned on and the output side of the transistor T4 has a high voltage.

In this case, a voltage drop occurs due to the transistor T5 in an ON state, and the output side of the transistor T5 has a buffered voltage (ON voltage) of the buffered voltage power line $V_{DD}$. Accordingly, the input side of the transistor T6 and the first electrode of the capacitor C1 have an ON voltage. In addition, since the gate of the transistor T6 and the second electrode of the capacitor C1 have a low voltage, the transistor T6 is turned off and the capacitor C1 is charged so that the first electrode becomes higher than the second electrode.

Then, the clock signal $V_{n+1}$ changes from high voltage to low voltage. Then, the clock signal $V_n$ changes from low voltage to high voltage. When the clock signal $V_{n+1}$ changes from high voltage to low voltage, the transistor T4 is turned off. In addition, when the clock signal V changes from low voltage to high voltage, the second electrode of the capacitor C1 has a high voltage, and the voltage of the first electrode of the capacitor C1 rises due to coupling of the capacitor C1. As a result, since the transistor T6 is turned on and a positive charge stored in the first electrode of the capacitor C1 moves to the node $NC_n$ through the transistor T6 in an ON state, the voltage at the node $NC_n$ rises. That is, the low voltage application ON control circuit 29 boosts the node $NC_n$ to the ON voltage at the timing at which the clock signal $V_n$ changes from low voltage to high voltage.

Then, the clock signal $V_n$ changes from high voltage to low voltage. Then, the clock signal $V_{n+1}$ changes from low voltage to high voltage. As a result, the transistor T6 is turned off, and the capacitor C1 is charged again. By repeating this, the node $NC_n$ maintains an ON voltage.

A transistor T10 is a second gate line low voltage application circuit. Similar to the transistor T9, the low voltage power line $V_{GL}$ is connected to the input side of the transistor T10, and the output terminal OUT1 is connected to the output side of the transistor T10. That is, the transistor T10 is disposed in parallel with the transistor T9 with respect to the output terminal OUT1. The input terminal IN1 is connected to a gate of the transistor T10. When the ON voltage is applied to the input terminal IN1, the transistor T10 is in an ON state. Accordingly, the transistor T10 applies a low voltage of the low voltage power line $V_{GL}$ to the output terminal OUT1.

A transistor T11 is a reset circuit. An input terminal IN4 is connected to the input side and a gate of the transistor T11 as diode connection. In addition, the start signal $V_{RES}$ is input to the input terminal IN4. In addition, the node $NC_n$ is connected to the output side of the transistor T11. The start signal $V_{RES}$ has an ON voltage at the start of the 1 frame period $T_F$ and has an OFF voltage in the other period. Accordingly, when the start signal $V_{RES}$ has an ON voltage, the transistor T11 of each shift register basic circuit SR to which the start signal $V_{RES}$ is input is turned on all at once, and the ON voltage is applied to the node NC of each shift register basic circuit SR. As a result, not only by the low voltage application ON control circuit 29 but also by the transistor T11, the ON voltage is stably maintained at the node $NC_n$ during a low signal period, and the transistor T9 which is turned on applies a low voltage to the output terminal OUT1 stably.

Figure 6:
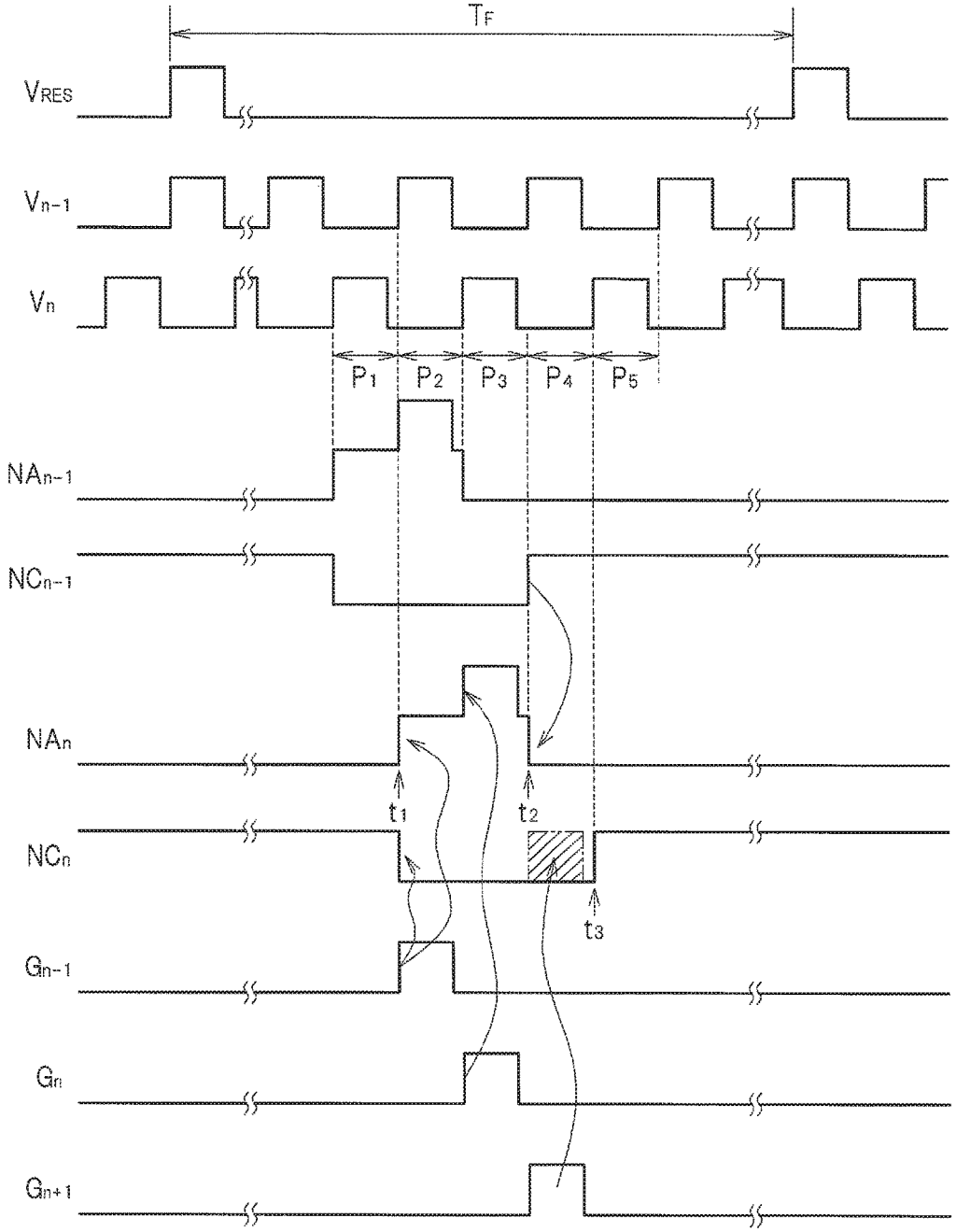
FIG. 6 is a view showing the driving of the gate signal line driving circuit according to the first embodiment of the invention.

FIG. 6 is a view showing driving of the gate signal line driving circuit 22 according to the present embodiment. FIG. 6 shows a case where the n-th shift register basic circuit $SR_n$ is an odd-numbered shift register basic circuit SR, and the clock signal $V_n$ is the clock signal $V_{CK1}$ and the clock signal $V_{n-1}$ is the clock signal $V_{CK2}$. In FIG. 6, the start signal $V_{RES}$, the clock signals $V_{n-1}$ and $V_n$ the nodes NA and NC of the (n−1)-th and n-th shift register basic circuits $SR_{n-1}$ and $SR_n$, and (n−1)-th to (n+1)-th gate signals $G_{n-1}$, $G_n$, and $G_{n+1}$ are shown according to the elapse of time. Periods (clocks) shown in FIG. 6 are $P_1$, $P_2$, $P_3$, $P_4$, $P_5$, and time shown in FIG. 6 is $t_1$, $t_2$, and $t_3$. Moreover, as described above, a period for which both two-phase clock signals have a low voltage is present.

Accordingly, for example, the period $P_1$ includes a period for which the clock signal $V_n$ has a high voltage and a period for which the clock signal $V_n$ has a low voltage. In addition, the node $NB_n$ of the n-th shift register basic circuit $SR_n$ is equal to or higher than the ON voltage during the same period as the period for which the node $NA_{n+1}$ of the (n+1)-th shift register basic circuit $SR_{n+1}$ is the ON voltage.

The node $NB_{n-1}$ of the (n−1)-th shift register basic circuit $SR_{n-1}$ is input to the input terminal IN2 of the n-th shift register basic circuit $SR_n$. Similarly, the node $NC_{n-1}$ is input to the input terminal IN3 of the n-th shift register basic circuit $SR_n$. In addition, the start signal $V_{RES}$ is input to the input terminal IN4 of each shift register basic circuit SR.

As shown in FIG. 6, a period for which the start signal $V_{RES}$ changes from low voltage to high voltage and then changes from low voltage to high voltage again is set as the 1 frame period $T_F$. Accordingly, the start signal $V_{RES}$ is also a signal which defines the start of the 1 frame period $T_F$. As described above, since the start signal $V_{RES}$ has an ON voltage at the start of the 1 frame period $T_F$, the reset circuit (transistor T11) of each shift register basic circuit SR applies the ON voltage to the node NC.

Then, in the period $P_1$, the node $NA_{n-1}$ is an ON voltage and the node $NC_{n-1}$ is an OFF voltage (low voltage). In addition, in the period $P_1$, the (n−1)-th gate signal $G_{n-1}$ has a low voltage, and the node $NB_{n-1}$ is a low voltage as will be described later.

Here, driving in the n-th shift register basic circuit $SR_n$ will be described. In the period $P_1$, the node $NB_{n-1}$ input to the input terminal IN2 is a low voltage and the node $NC_{n-1}$ input to the input terminal IN3 is an OFF voltage and accordingly, the transistor T8 is turned off. Therefore, the input side of the transistor T2 is a low voltage (OFF voltage), and the node $NA_n$ maintains an OFF voltage through the transistor T2 in the ON state. Since the node $NA_n$ is an OFF voltage, the transistors T1 and T14 are turned off. Accordingly, the node $NB_n$ maintains a low voltage. In addition, the node $NC_n$ maintains an ON voltage through the low voltage application ON control circuit 29.

At time $t_1$, the clock signal $V_{n-1}$ changes from low voltage to high voltage. According to the change of the gate signal $G_{n-1}$ from low voltage to high voltage, the node $NB_{n-1}$ changes from low voltage to high voltage. As a result, the node $NA_n$ changes from OFF voltage to ON voltage through the transistor T2 in the ON state. In addition, the transistor T8 maintains an OFF state. In addition, since the gate of the transistor T7 changes from low voltage to high voltage, the transistor T7 is turned on and the node $NC_n$ changes from ON voltage to OFF voltage.

As described above, in the period $P_2$, the node $NA_n$ is an ON voltage and the node $NC_n$ is an OFF voltage. In addition, since the node $NA_n$ is an ON voltage, the transistors T1 and T14 are turned on. In the period $P_2$, however, the clock signal $V_n$ has a low voltage. Accordingly, since the transistor T1 applies a low voltage of the clock signal $V_n$ to the output terminal OUT1, the gate signal $G_n$ maintains a low voltage. Moreover, similarly, the transistor T14 applies a low voltage to the gate and the input side of the transistor T3 and accordingly, the transistor T3 is turned off. Therefore, the node $NB_n$ maintains a low voltage similar to the gate signal $G_n$, as will be described later.

In the period $P_3$ (except for a part), the clock signal $V_n$ has a high voltage. During a period for which the clock signal $V_n$ has a high voltage, the transistor T1 in the ON state applies a high voltage of the clock signal $V_n$ to the output terminal OUT1. That is, a period for which the clock signal $V_n$ has a high voltage in the period $P_3$ is a high signal period. During the high signal period, the gate signal $G_n$ output from the output terminal OUT1 has a high voltage. Similarly, during the high signal period, the transistor T14 in the ON state outputs a high voltage of the clock signal $V_n$, and the node $NB_n$ which is a voltage applied to the output terminal OUT2 becomes a high voltage through the transistor T3 in the ON state.

In practice, in the period $P_2$, the node $NA_n$ is an ON voltage which is a voltage lower than the high voltage of the clock signal $V_n$. In the period $P_3$, this voltage is not sufficient to turn on the transistor T1 completely. However, the transistor T1 is formed so that the parasitic capacitance C (not shown) is generated between the gate and the output side of the transistor T1. In the period $P_2$, the voltage of the node $NA_n$ becomes an ON voltage, and the parasitic capacitance C is charged with this voltage. At the start time of the period $P_3$, the node $NA_n$ maintains an ON voltage and the transistor T1 maintains an ON state. The clock signal $V_n$ with a high voltage is input to the input side of the transistor T1 in the ON state, and this increases an output-side voltage of the transistor T1. In this case, the node $NA_n$ is increased to a voltage, which is obtained by adding the voltage of the parasitic capacitance C to the output-side voltage, by capacitive coupling of the parasitic capacitance C. This is called a bootstrap effect. Then, since the transistor T1 is turned on, the gate signal $G_n$ output from the output terminal OUT1 is increased to approximately the same voltage as a high voltage of the input clock signal $V_n$. FIG. 6 shows a state where the voltage of the node $NA_n$ is increased by the bootstrap effect during a period for which the gate signal $G_n$ has a high voltage in the period $P_3$. In addition, it is preferable to form the transistor T1 such that the parasitic capacitance generated between the gate and the output side of the transistor T1 is large and the parasitic capacitance generated between the gate and the input side of the transistor T1 is small. In addition, when the parasitic capacitance present between the gate and the output side is not sufficiently large, it is preferable to dispose a capacitor between the gate and the output side.

Even if the node $NA_n$ is increased to a voltage higher than the ON voltage by the bootstrap effect, the voltage of the input terminal IN2 becomes an ON voltage since the transistor T2 in the ON state drops to a buffered voltage. That is, the node $NB_{n-1}$ connected to the input terminal IN2 is an ON voltage during the period $P_3$.

At time $t_2$, the clock signal $V_{n-1}$ changes from low voltage to high voltage. Then, the node $NC_{n-1}$ changes from OFF voltage to ON voltage by the low voltage application ON control circuit 29 of the (n−1)-th shift register basic circuit $SR_{n-1}$. Then, the gate of the transistor T8 connected to the input terminal IN3 to which the node $NC_{n-1}$ is connected changes from OFF voltage to ON voltage, and the transistor T8 is turned on. Then, the transistor T8 applies a low voltage (OFF voltage) of the low voltage power line $V_{GL}$ to the input side of the transistor T2. Through the transistor T2 in the ON state, the node $NA_n$ changes from ON voltage to OFF voltage. That is, the OFF voltage is applied to the node $NA_n$ by the transistor T8 which is turned on at a timing at which the node $NC_{n-1}$ changes from OFF voltage to ON voltage. Accordingly, the transistors T1 and T14 are turned off. At the same time, since the gate of the transistor T7 changes from ON voltage to OFF voltage by the transistor T8 in the ON state, the transistor T7 is turned off. Accordingly, during the period $P_4$, the node $NA_n$ is an OFF voltage, and the transistors T1 and T14 are turned off. In addition, during the period $P_4$, the clock signal $V_n$ is a low voltage, and the transistor T6 is in an OFF state. Accordingly, the node $NC_n$ maintains an OFF voltage. In addition, the transistor T9 maintains an OFF state.

Thus, since both the transistors T1 and T9 are in the OFF state during the period $P_4$, the output terminal OUT1 is in a float state if there is no transistor T10. However, since the (n+1)-th gate signal $G_{n+1}$ is input to the input terminal IN1 connected to the gate of the transistor T10 and the gate signal $G_{n+1}$ changes from low voltage to high voltage at time $t_2$, the transistor T10 is turned on. Accordingly, during the high signal period of the (n+1)-th gate signal $G_{n+1}$, the transistor T10 is in an ON state, and the transistor T10 applies the low voltage of the low voltage power line $V_{GL}$ to the output terminal OUT1.

Although the node $NC_n$ maintains an OFF voltage during the period $P_4$ in FIG. 6, a period for which the gate signal $G_{n+1}$ has a high voltage and the transistor T10 is turned on is shown by oblique lines so as to overlap the voltage of the node $NC_n$. That is, the transistor T10 is in an ON state at least in a part of the period until the node $NA_n$ changes from ON voltage to low voltage and accordingly the node $NC_n$ changes from OFF voltage to ON voltage, and the period for which the transistor T10 is in an ON state is a period shown by oblique lines.

After the clock signal $V_{n-1}$ changes from high voltage to low voltage, the clock signal $V_n$ changes from low voltage to high voltage and the node $NC_n$ changes from OFF voltage to ON voltage by the low voltage application ON control circuit 29 at time $t_3$. Accordingly, during the period $P_5$, the node $NC_n$ becomes an ON voltage. Even after the period $P_5$, the low voltage application ON control circuit 29 boosts the node $NC_n$ to the ON voltage periodically (every two clocks), so that the node $NC_n$ maintains an ON voltage.

In addition, at time $t_2$, the transistor T8 is turned on when the node $NC_{n-1}$ changes from OFF voltage to ON voltage, and the transistor T8 applies a low voltage of the low voltage power line $V_{GL}$ to the input side of the transistor T2 and the input terminal IN2. Accordingly, the node $NB_{n-1}$ of the (n−1)-th shift register basic circuit $SR_{n-1}$ connected to the input terminal IN2 changes from ON voltage to low voltage (OFF voltage). Then, since the node $NC_{n-1}$ maintains an ON voltage, the node $NB_{n-1}$ maintains a low voltage in the meantime.

Similarly, at time t3, the node $NC_n$ changes from OFF voltage to ON voltage and accordingly, the node $NB_n$, changes from ON voltage to low voltage (OFF voltage). Then, the node $NB_n$ maintains a low voltage. In addition, when the node $NC_n$, changes from ON voltage to OFF voltage at time $t_1$, the transistors T8 of the (n+1)-th shift register basic circuit $SR_{n+1}$ is turned off. However, a low voltage is maintained at the input terminal IN2 of the (n+1)-th shift register basic circuit $SR_{n+1}$ during the period $P_2$ and accordingly, the node $NB_n$ maintains a low voltage similarly. Accordingly, the node $NB_n$ becomes equal to or higher than the ON voltage during the periods $P_3$ and $P_4$. This period is equal to the period for which the node $NA_{n+1}$ is an ON voltage.

Here, it is assumed that the node $NB_{n-1}$ is input to the input terminal IN2 of the n-th shift register basic circuit $SR_n$. Accordingly, the n-th gate signal $G_n$ is not directly influenced by voltage changes of the (n+1)-th (next-stage) input terminal IN2, and this improves the quality of the gate signal $G_n$. However, in the case of driving only in the forward direction like the gate signal line driving circuit 22 according to the present embodiment, the (n−1)-th (preceding-stage) gate signal $G_{n-1}$ may be input to the node $NB_{n-1}$. In this case, in order to suppress the influence of the voltage output from the transistor T8 or the voltage of the node $NA_n$ to the (n−1)-th gate signal $G_{n-1}$, it is necessary to provide the transistor T3 between the input terminal IN2 and the input side of the transistor T2 (output side of the transistor T8). In this case, since it is not necessary to newly provide the transistor T14, the circuit size is reduced.

In addition, clock signals input to the gate signal line driving circuit 22 herein are the two-phase clock signals $V_{CK1}$ and $V_{CK2}$. Using the two-phase clock signals $V_{CK1}$ and $V_{CK2}$, the low voltage application ON control circuit 29 boosts the node $NC_n$ to the ON voltage every two clocks. Therefore, as shown in FIG. 6, the low voltage application ON control circuit 29 changes the node $NC_n$ from OFF voltage to ON voltage at time $t_3$ which is after 1 clock after the node $NA_n$ changes from ON voltage to OFF voltage at time $t_2$. That is, the low voltage application ON control circuit 29 changes the node $NC_n$ from OFF voltage to ON voltage at time $t_3$ according to the two-phase clock signals without requiring a control signal from the outside. Thus, since a control signal from the outside is not required, it is possible to reduce the circuit size.

In addition, clock signals input to the gate signal line driving circuit 22 are not limited to the two-phase clock signals $V_{CK1}$ and $V_{CK2}$. In general, m-phase (m is 2 or more) clock signals may be input to the gate signal line driving circuit 22. In each shift register basic circuit SR, preferably, when there is a period (a time difference occurs) between the timing at which the node NA changes from ON voltage to OFF voltage and the timing at which the low voltage application ON control circuit 29 boosts the node NC, the second gate line low voltage application circuit (transistor T10) is turned on at least in a part of the period so that the second gate line low voltage application circuit applies a low voltage to the output terminal OUT1.

In addition, the transistors T8 and T11 may not be provided in the dummy circuit $SR_0$ shown in FIG. 4. Thus, since one or more dummy circuits are disposed before the first shift register basic circuit $SR_1$, it is possible to generate a required clock even if a control signal is not newly input from the outside. For example, when there are 854 shift register basic circuits, it is preferable to provide a dummy circuit $SR_{855}$ after the 854-th shift register basic circuit $SR_{854}$ and to connect the dummy circuit $SR_{855}$ so that a dummy gate signal $G_{855}$ output from the dummy circuit $SR_{855}$ is input to the input terminal IN1 of the 854-th shift register basic circuit $SR_{854}$. Similarly, even if a new control signal is not input from the outside, it is possible to generate a required clock by the dummy circuit $SR_{855}$.

[Second Embodiment]

A display device according to a second embodiment of the invention has basically the same configuration as the display device according to the first embodiment. The main difference between the display device according to the second embodiment and the display device according to the first embodiment is that the gate signal line driving circuit 22 according to the present embodiment can perform bidirectional driving so that either forward driving or reverse driving can be selectively performed.

In the gate signal line driving circuit 22 according to the first embodiment, both the gate signal line driving circuit 22R shown at the right side of FIG. 2 and the gate signal line driving circuit 22L shown at the left of FIG. 2 perform forward driving. In contrast, in the gate signal line driving circuit 22 according to the present embodiment, the gate signal line driving circuit 22L shown at the left of FIG. 2 is not driven when the gate signal line driving circuit 22R shown at the right side of FIG. 2 is driven, for example. In this case, the gate signal line driving circuit 22R performs forward driving for outputting a high-voltage gate signal to the corresponding gate signal line 105 in order of the forward direction. In addition, when the gate signal line driving circuit 22L shown at the left of FIG. 2 is driven, the gate signal line driving circuit 22R shown at the right side of FIG. 2 is not driven. In this case, the gate signal line driving circuit 22L performs reverse driving for outputting a high-voltage gate signal to the corresponding gate signal line 105 in the opposite order to the forward direction (order of a reverse direction).

Moreover, for example, when there are 854 gate signal lines 105, each of the gate signal line driving circuit 22R which performs forward driving and the gate signal line driving circuit 22L which performs reverse driving includes 854 shift register basic circuits SR.

The block diagram of the plural shift register basic circuits SR shown in FIG. 4 shows a case of performing forward driving, and the plural shift register basic circuits SR shown in FIG. 4 correspond to the plural shift register basic circuits SR provided in the gate signal line driving circuit 22R which performs forward driving. In order to show clearly that the two-phase clock signals $V_{CK1}$ and $V_{CK2}$ and the start signal $V_{RES}$ shown in FIG. 4 are connected to the gate signal line driving circuit 22R at the right side, they are expressed as two-phase clock signals $V_{CK1(R)}$ and $V_{CK2(R)}$ and start signal $V_{RES(R)}$, respectively. Similarly, in order to show clearly that the two-phase clock signals $V_{CK1}$ and $V_{CK2}$ and the start signal $V_{RES}$ shown in FIG. 4 are connected to the gate signal line driving circuit 22L which performs reverse driving, they are expressed as two-phase clock signals $V_{CK1(L)}$ and $V_{CK2(L)}$ and start signal $V_{RES(L)}$, respectively. Driving direction control lines $V_{DR(R)}$ and $V_{DR(L)}$ are further connected to the gate signal line driving circuits 22R and 22L according to the present embodiment, respectively.

In addition, in the gate signal line driving circuit 22L which performs reverse driving, nodes $NB_{n+1}$ and $NC_{n+1}$ output from the output terminals OUT2 and OUT3 of the (n+1)-th shift register basic circuit $SR_{n+1}$ are input to the input terminals IN2 and IN3 of the n-th shift register basic circuit $SR_n$, respectively. In addition, the (n−1)-th gate signal $G_{n-1}$ is input to the input terminal IN1 of the n-th shift register basic circuit $SR_n$. In general, for the n-th shift register basic circuit $SR_n$ in order of the reverse direction among the plural shift register basic circuits SR which output high-voltage gate signals, the preceding shift register basic circuit SR indicates an (n+1)-th shift register basic circuit $SR_{n+1}$ and the subsequent shift register basic circuit SR indicates an (n−1)-th shift register basic circuit $SR_{n-1}$. In addition, a dummy circuit $SR_{855}$, is disposed before the 854-th shift register basic circuit $SR_{854}$, and the start signal $V_{RES}$ is input to the input terminal IN2 similar to the dummy circuit $SR_0$ shown in FIG. 4. A dummy circuit $SR_0$ is disposed after the first shift register basic circuit $SR_1$, and a dummy gate signal $G_0$ output from the dummy circuit $SR_0$ is input to the input terminal IN1 of the first shift register basic circuit $SR_1$.

Figure 7:
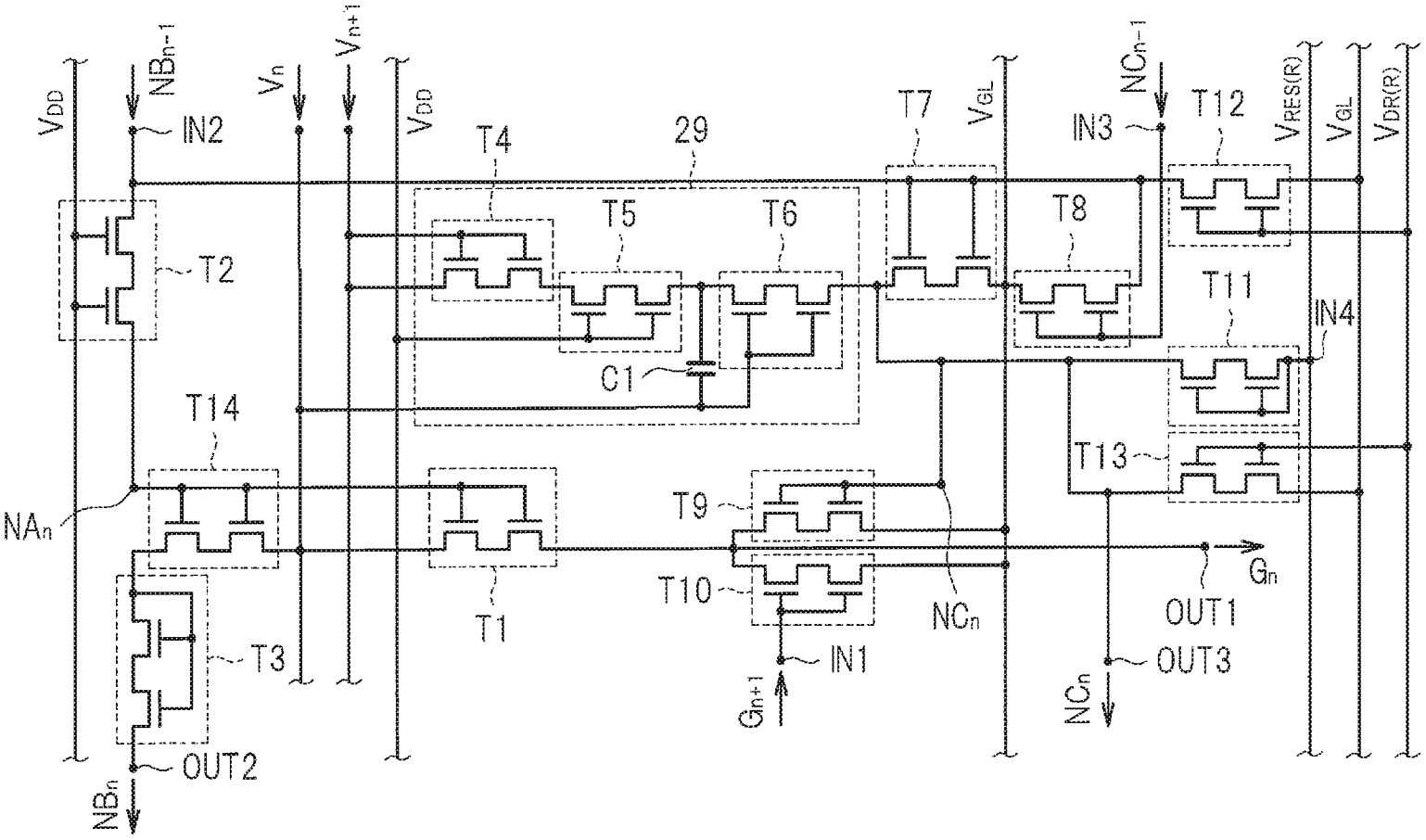
FIG. 7 is a circuit diagram of an n-th shift register basic circuit of a gate signal line driving circuit according to a second embodiment of the invention, which performs forward driving.

FIG. 7 is a circuit diagram of the n-th shift register basic circuit $SR_n$ of the gate signal line driving circuit 22R according to the present embodiment which performs forward driving.

The main difference between the n-th shift register basic circuit $SR_n$ according to the first embodiment shown in FIG. 5 and the n-th shift register basic circuit $SR_n$ according to the present embodiment shown in FIG. 7 is that the n-th shift register basic circuit $SR_n$ according to the present embodiment shown in FIG. 7 further includes a driving direction control line $V_{DR}$ and also further includes a high voltage application driving OFF control circuit (transistor T12) and a low voltage application driving OFF control circuit (transistor T13).

A transistor T12 is a high voltage application driving OFF control circuit which is turned on when the driving direction is different in order to apply an OFF voltage to the node NA. The driving direction control line $V_{DR}$ is connected to the gate of the transistor T12, the low voltage power line $V_{GL}$ is connected to the input side of the transistor T12, and the output side of the transistor T12 is connected to the input side of the transistor T2.

Similarly, a transistor T13 is a low voltage application driving OFF control circuit which is turned on when the driving direction is different in order to apply an OFF voltage to the node NC. The driving direction control line $V_{DR}$ is connected to the gate of the transistor T13, the low voltage power line $V_{GL}$ is connected to the input side of the transistor T13, and the node $NC_n$ is connected to the output side of the transistor T13.

The driving direction control line $V_{DR(R)}$ connected to the gate signal line driving circuit 22R which performs forward driving has a low voltage at the time of forward driving and has an intermediate voltage $V_M$ when performing reverse driving. That is, the driving direction control line $V_{DR}$ has an OFF voltage when the driving direction selected from two directions is the same as a driving direction of a gate signal line driving circuit connected to the driving direction control line $V_{DR}$ and has an intermediate voltage $V_M$ when the driving direction selected from two directions is different from the driving direction of the gate signal line driving circuit connected to the driving direction control line $V_{DR}$.

Here, the intermediate voltage $V_M$ is a voltage between a high voltage and a low voltage and is a sufficient voltage for turning on a transistor compared with the low voltage, similar to the buffered voltage which is a voltage of the buffered voltage power line $V_{DD}$. For example, when the high voltage is +10 V and the low voltage is −7 V an appropriate voltage higher than −7 V and lower than +10 V is preferably selected as the intermediate voltage $V_M$. If the intermediate voltage $V_M$ is set to be the same as the buffered voltage of the buffered voltage power line $V_{DD}$, it is possible to reduce power consumption without requiring a new voltage source in order to generate a voltage of the driving direction control line $V_{DR}$. In addition, if the intermediate voltage $V_M$ is set as the ground voltage GND, it is possible to further reduce power consumption.

Since the driving direction control line $V_{DR(R)}$ has a low voltage at the time of forward driving, a low voltage (OFF voltage) is applied to each gate of the transistors T12 and T13. As a result, both the transistors T12 and T13 maintain an OFF state. Since the driving direction control line $V_{DR(R)}$ has an intermediate voltage $V_M$ at the time of reverse driving, the intermediate voltage $V_M$ which is an ON voltage is applied to each gate of the transistors T12 and T13. As a result, both the transistors T12 and T13 maintain an ON state.

Since the transistor T12 in the ON state applies the low voltage of the low voltage power line $V_{GL}$ to the input side of the transistor T2, the node $NA_n$ maintains an OFF voltage through the transistor T2 in the ON state. That is, when the transistor T12 is turned on, the OFF voltage is applied to the node $NA_n$. In this case, since the transistor T1 maintains an OFF state, the transistor T1 does not apply the clock signal $V_n$ to the output terminal OUT1. Since the transistor T14 maintains an OFF state, the node $NB_n$, output from the output terminal OUT2 does not become a high voltage. Similarly, since the transistor T13 in the ON state applies the low voltage (OFF voltage) of the low voltage power line $V_{CL}$ to the node $NC_n$, the transistor T9 maintains an OFF state.

Figure 8:
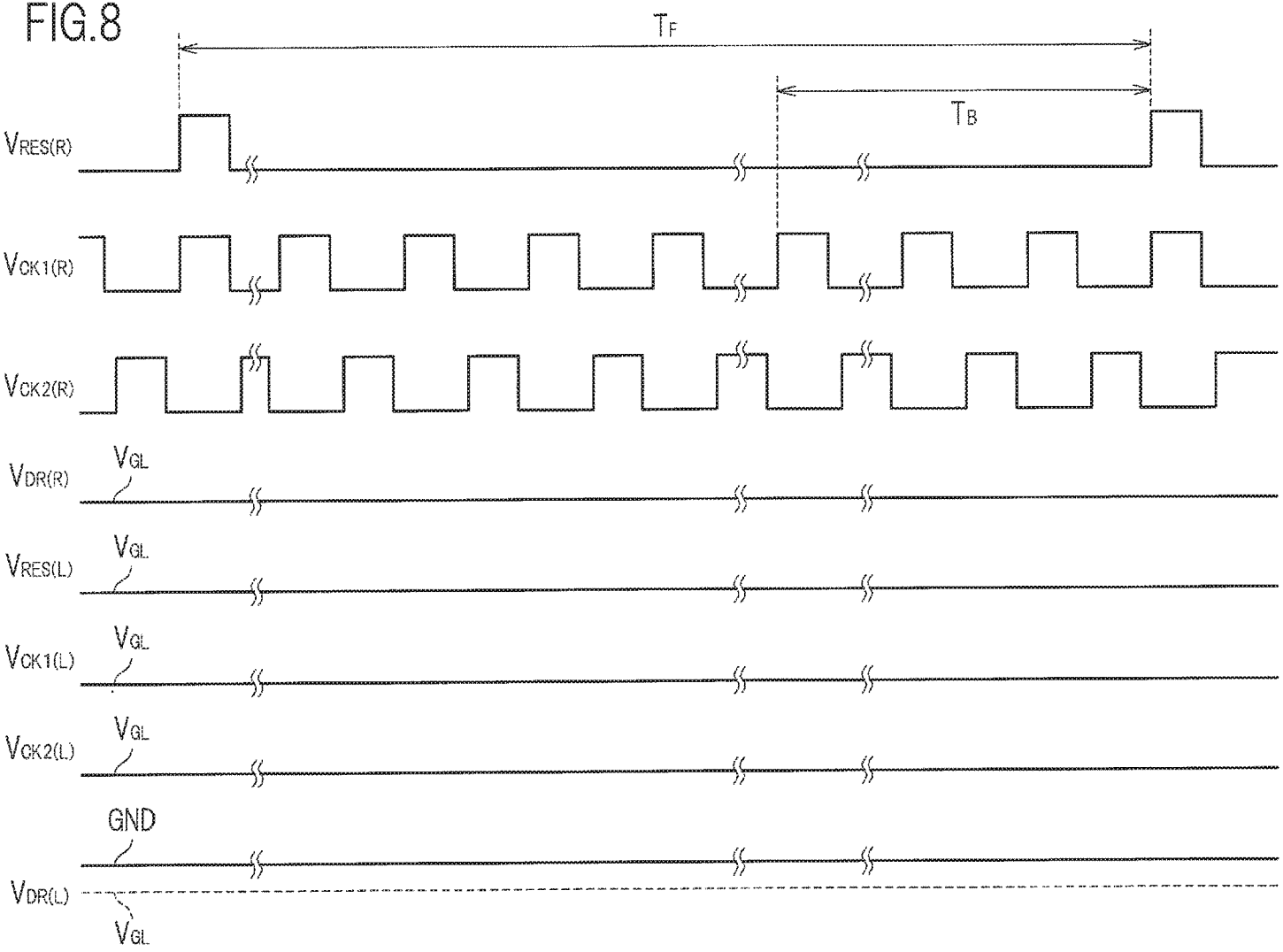
FIG. 8 is a view showing forward driving of the gate signal line driving circuit according to the second embodiment of the invention.

FIG. 8 is a view showing forward driving of the gate signal line driving circuit 22 according to the present embodiment. In the case of performing forward driving, the start signal $V_{RES(R)}$ and the clock signals $V_{CK1(R)}$ and $V_{CK2(R)}$ connected to the gate signal line driving circuit 22R which performs forward driving are the same as those in the driving shown in FIG. 6. In addition, as described above, the driving direction control line $V_{DR(R)}$ maintains a low voltage. Accordingly, the transistors T12 and T13 maintain an OFF state.

In contrast, the start signal $V_{RES(L)}$ and the clock signals $V_{CK1(L)}$ and $V_{CK2(L)}$ connected to the gate signal line driving circuit 22L which performs reverse driving maintain a low voltage, and the driving direction control line $V_{DR(L)}$ maintains the intermediate voltage $V_M$. Here, a case where the intermediate voltage $V_M$ is the ground voltage GND is shown.

As described above, when the driving direction control line $V_{DR(L)}$ maintains the intermediate voltage $V_M$, the transistors T12 and T13 in each shift register basic circuit SR of the gate signal line driving circuit 22L which performs reverse driving are turned on. Accordingly, since both the nodes NA and NC maintain an OFF voltage, each shift register basic circuit SR does not contribute to the output to the output terminal OUT1 at all.

In addition, when the gate signal line driving circuit 22 according to the present embodiment performs reverse driving, the start signal $V_{RES(L)}$, the clock signals $V_{CK1(L)}$ and $V_{CK2(L)}$, and the driving direction control line $V_{DR(L)}$, which are connected to the gate signal line driving circuit 22L which performs reverse driving, perform the same driving as the start signal $V_{RES(R)}$, the clock signals $V_{CK1(R)}$ and $V_{CK2(R)}$, and the driving direction control line $V_{DR(R)}$ shown in FIG. 8, respectively. In contrast, the start signal $V_{RES(R)}$, the clock signals $V_{CK1(R)}$ and $V_{CK2(R)}$, and the driving direction control line $V_{DR(R)}$, which are connected to the gate signal line driving circuit 22R which performs forward driving, perform the same driving as the start signal $V_{RES(L)}$, the clock signals $V_{CK1(L)}$ and $V_{CK2(L)}$, and the driving direction control line $V_{DR(L)}$ shown in FIG. 8, respectively.

For example, in the case of performing forward driving as shown in FIG. 8, the gate signal line driving circuit 22L which performs reverse driving is not driven. In this case, the driving direction control line $V_{DR(L)}$ maintains the intermediate voltage $V_M$, and the intermediate voltage $V_M$ of the driving direction control line $V_{DR(L)}$ is applied to gates of both the transistors T12 and T13 of each shift register basic circuit SR provided in the gate signal line driving circuit 22L. As a result, both the transistors T12 and T13 maintain an ON state. In general, when a DC stress is applied to the gate of a transistor for a long time, the threshold voltage $V_{TH}$ of the transistor is shifted to the negative side by the influence of Na contamination in the manufacturing process and the like. However, by setting a voltage applied to the gates of the transistors T12 and T13 to the intermediate voltage $V_M$ lower than a high voltage, the shift of the threshold voltage $V_{TH}$ of the transistors T12 and T13 to the negative side is suppressed. This improves there liability of the gate signal line driving circuit 22. By setting the intermediate voltage $V_M$ to the ground voltage GND, it is possible to reduce power consumption as described above.

[Third Embodiment]

A display device according to a third embodiment of the invention has basically the same configuration as the display device according to the second embodiment. Similar to the gate signal line driving circuit 22 according to the second embodiment, a gate signal line driving circuit 22 according to the present embodiment can perform bidirectional driving so that either forward driving or reverse driving can be selectively performed. In addition, the main difference between the display device according to the third embodiment and the display device according to the second embodiment is the configuration of the shift register basic circuit SR.

Figure 9:
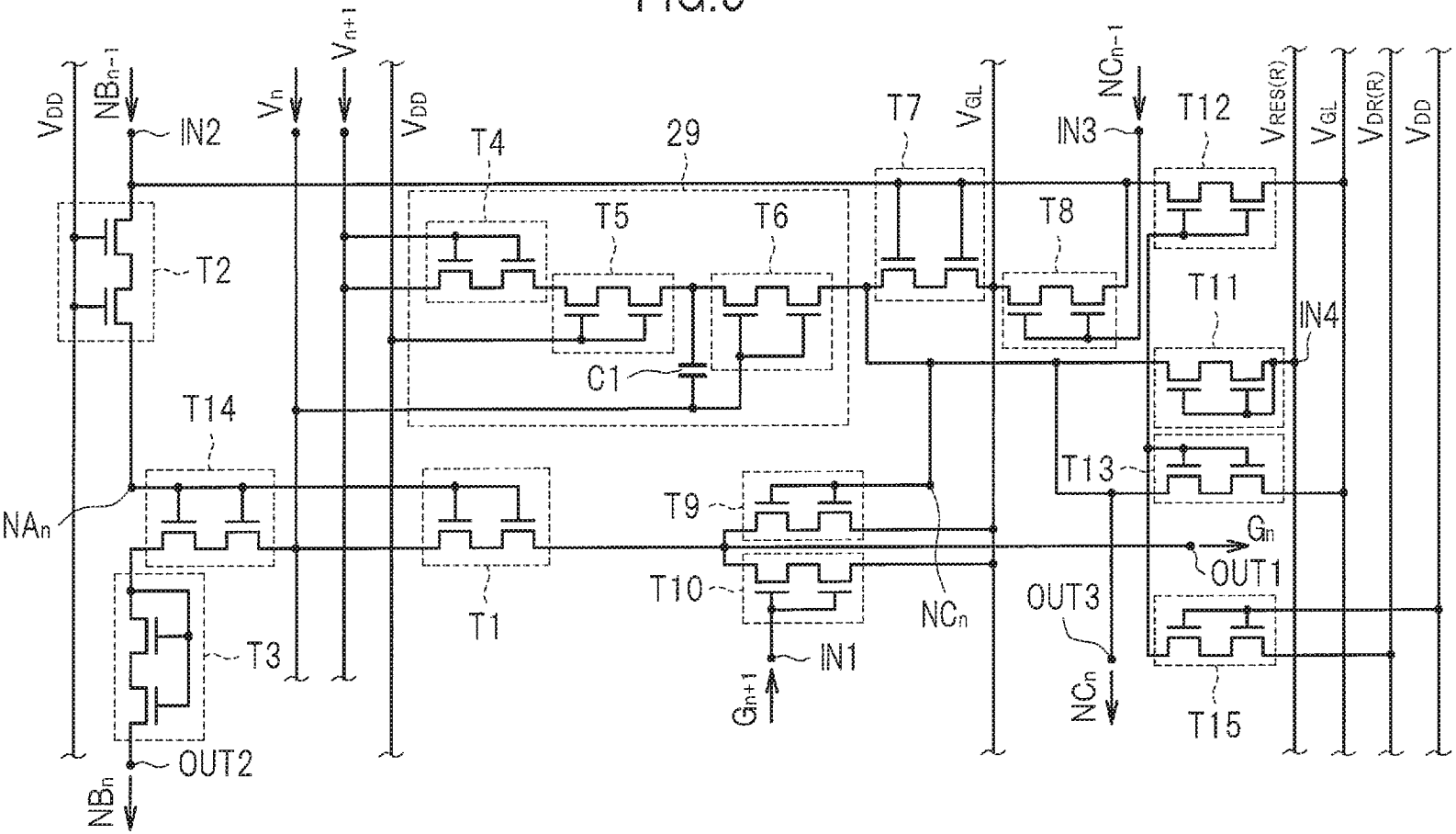
FIG. 9 is a circuit diagram of an n-th shift register basic circuit of a gate signal line driving circuit according to a third embodiment of the invention, which performs forward driving.

FIG. 9 is a circuit diagram of an n-th shift register basic circuit $SR_n$ of a gate signal line driving circuit 22R according to the present embodiment which performs forward driving. Compared with the circuit diagram of the n-th shift register basic circuit $SR_n$ according to the second embodiment shown in FIG. 7, the n-th shift register basic circuit $SR_n$ according to the present embodiment further includes a switching control circuit (transistor T15).

A transistor T15 is a switching control circuit, and supplies a control voltage to a switch (gate) of the high voltage application driving OFF control circuit (transistor T12) or the low voltage application driving OFF control circuit (transistor T13). The buffered voltage power line $V_{DD}$ is connected to the gate of the transistor T15, so that an ON voltage is applied to the gate of the transistor T15. The driving direction control line $V_{DR}$ is connected to the input side of the transistor T15, and the output side of the transistor T15 is connected to the gates of the transistors T12 and T13. The voltage of the driving direction control line $V_{DR}$ is applied to the gates of the transistors T12 and T13 as a control voltage through the transistor T15 in the ON state. In addition, when the voltage of the driving direction control line $V_{DR}$ is higher than the buffered voltage of the buffered voltage power line $V_{DD}$, the voltage of the driving direction control line $V_{DR}$ drops to the buffered voltage due to the transistor T15, and this voltage becomes a control voltage.

Figure 10:
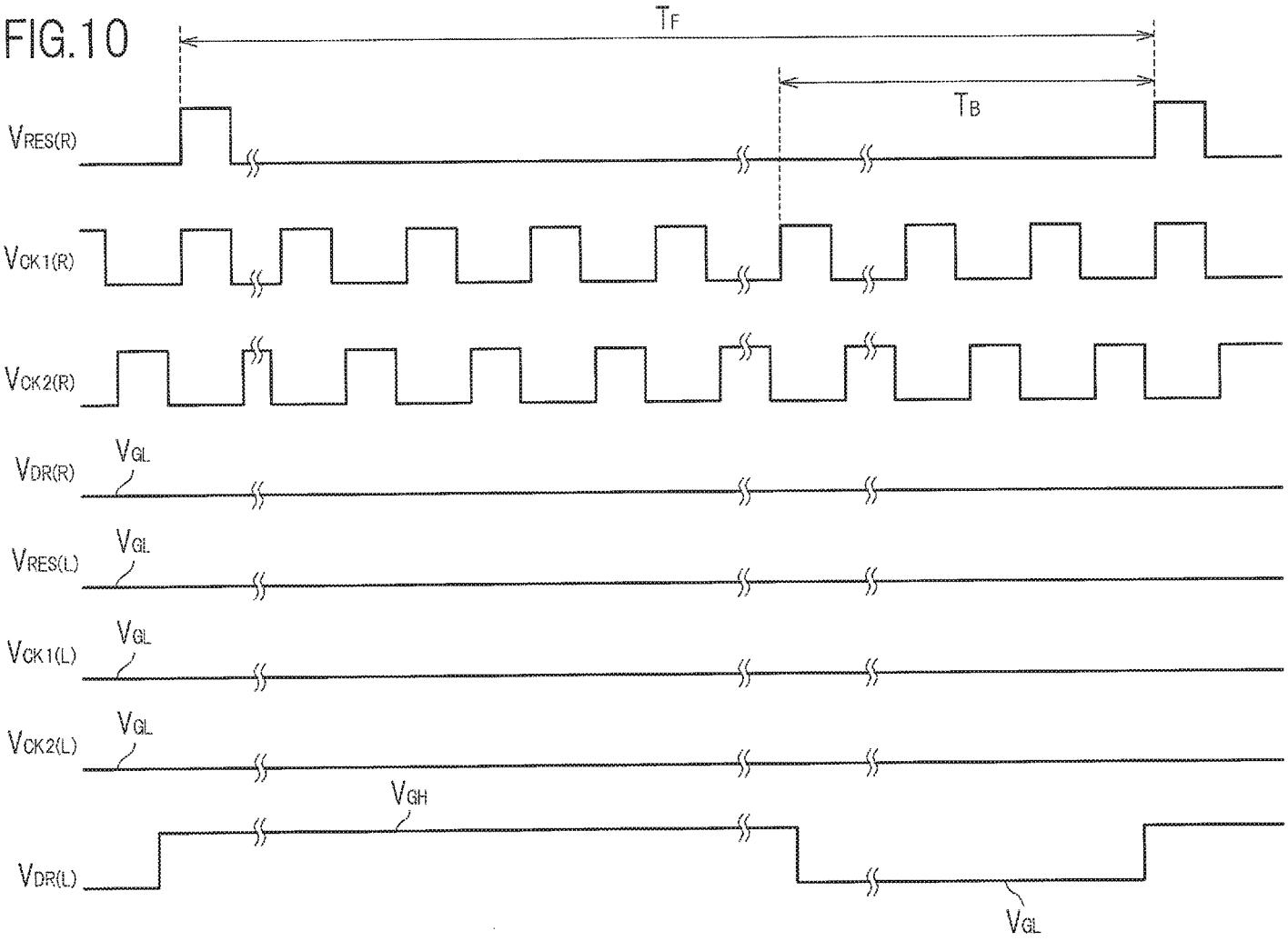
FIG. 10 is a view showing forward driving of the gate signal line driving circuit according to the third embodiment of the invention.

FIG. 10 is a view showing forward driving of the gate signal line driving circuit 22 according to the present embodiment. In the case of performing forward driving, the start signal $V_{RES(R)}$ and the clock signals $V_{CK1(R)}$ and $V_{CK2(R)}$ connected to the gate signal line driving circuit 22R which performs forward driving are the same as those in the driving shown in FIG. 8. In addition, as described above, the driving direction control line $V_{DR(R)}$ maintains a low voltage.

The start signal $V_{RES(L)}$ and the clock signals $V_{CK1(L)}$ and $V_{CK2(L)}$ connected to the gate signal line driving circuit 22L which performs reverse driving maintain a low voltage, as in FIG. 8. FIG. 10 is different from FIG. 8 in that the voltage of the driving direction control line $V_{DR(L)}$ is the same as a clock signal and repeats a high voltage $V_{GH}$ and a low voltage $V_{GL}$. Here, the driving direction control line $V_{DR(L)}$ has a low voltage during at least a part of a blanking period $T_B$ of the 1 frame period $T_F$ and has a high voltage in the other period. In addition, the blanking period $T_B$ refers to a period, for which all gate signals have a low voltage, of the 1 frame period $T_F$. That is, in the blanking period $T_B$, no gate signal has a high voltage (no high signal period).

By repeating a high voltage and a low voltage as a voltage of the driving direction control line $V_{DR}$ similar to the clock signal, it is possible to generate the driving direction control line $V_{DR}$ using a voltage source required to generate the two-phase clock signals $V_{CK1}$ and $V_{CK2}$ and a new voltage source is not required.

As shown in FIG. 10, the driving direction control line $V_{DR(L)}$ maintains a high voltage in a period, for which any one of the plural gate signals output from the gate signal line driving circuit 22R which performs forward driving has a high voltage, of the 1 frame period $T_F$. Accordingly, in this period, a high voltage which is a voltage of the driving direction control line $V_{DR(L)}$ is applied to the input side of the transistor T15 in each shift register basic circuit SR of the gate signal line driving circuit 22L which performs reverse driving, and the buffered voltage of the buffered voltage power line $V_{DD}$ is applied to the gate of the transistor T15. As a result, a buffered voltage dropped from the high voltage is output from the output side of the transistor T15, and the buffered voltage is applied as an ON voltage to the gates of the transistors T12 and T13.

In addition, as shown in FIG. 10, the driving direction control line $V_{DR(L)}$ maintains a low voltage in at least a part of the blanking period $T_B$ of the 1 frame period $T_F$. Accordingly, in this period, a low voltage which is a voltage of the driving direction control line $V_{DR(L)}$ is applied to the input side of the transistor T15 in each shift register basic circuit SR of the gate signal line driving circuit 22L which performs reverse driving, and the transistor T15 applies a low voltage to the gates of the transistors T12 and T13. As a result, the transistors T12 and T13 are turned off.

In addition, when the gate signal line driving circuit 22 according to the present embodiment performs reverse driving, the start signal $V_{RES(L)}$, the clock signals $V_{CK1(L)}$ and $V_{CK2(L)}$, and the driving direction control line $V_{DR(L)}$, which are connected to the gate signal line driving circuit 22L which performs reverse driving, perform the same driving as the start signal $V_{RES(R)}$, the clock signals $V_{CK1(R)}$ and $V_{CK2(R)}$, and the driving direction control line $V_{DR(R)}$ shown in FIG. 10, respectively. In contrast, the start signal $V_{RES(R)}$, the clock signals $V_{CK1(R)}$ and $V_{CK2(R)}$, and the driving direction control line $V_{DR(R)}$, which are connected to the gate signal line driving circuit 22R which performs forward driving, perform the same driving as the start signal $V_{RES(L)}$, the clock signals $V_{CK1(L)}$ and $V_{CK2(L)}$, and the driving direction control line $V_{DR(L)}$, shown in FIG. 10, respectively.

For example, in the case of performing forward driving as shown in FIG. 10, the gate signal line driving circuit 22L which performs reverse driving is not driven. The transistors T12 and T13 of the plural shift register basic circuits SR which are not driven are turned on when the driving direction control line $V_{DR}$ has a high voltage, but the voltage applied to the gates of the transistors T12 and T13 drops to the buffered voltage of the buffered voltage power line $V_{DD}$ even though the voltage of the driving direction control line $V_{DR}$ is a high voltage. Accordingly, the shift of the threshold voltage $V_{TH}$ of the transistors T12 and T13 to the negative side is suppressed. In this case, although the buffered voltage is applied to the gate of the transistor T15, the buffered voltage is a voltage lower than the high voltage at the input side. Accordingly, the shift of the threshold voltage $V_{TH}$ of the transistor T15 to the negative side is suppressed.

By applying a low voltage to the gates of the transistors T12 and T13 in at least a part of the blanking period $T_B$ of the 1 frame period $T_F$ in order to turn off the transistors T12 and T13, the shift of the threshold voltage $V_{TH}$ of the transistors T12 and T13 to the negative side is further suppressed, compared with that when the transistors T12 and T13 have an ON state for a long time. This improves the reliability of the gate signal line driving circuit 22.

Here, although the voltage of the driving direction control line $V_{DR}$ is set to repeat a high voltage and a low voltage, the voltage of the driving direction control line $V_{DR}$ is not limited to this. Using the intermediate voltage $V_M$ instead of a high voltage as in the second embodiment, the voltage of the driving direction control line $V_{DR}$ may also be set to repeat the intermediate voltage $V_M$ and a low voltage. In addition, the intermediate voltage $V_M$ may be set to be the same as the buffered voltage of the buffered voltage power line $V_{DD}$, and the intermediate voltage $V_M$ may be set as the ground voltage GND.

In addition, in the second embodiment, the voltage of the driving direction control line $V_{DR}$ connected to the plural shift register basic circuits SR which are not driven is maintained as the intermediate voltage $V_M$. However, the voltage of the driving direction control line $V_{DR}$ may also be set as a low voltage in at least a part of the blanking period $T_B$ of the 1 frame period $T_F$, as in the third embodiment. In this case, since the shift of the threshold voltage $V_{TH}$ of the transistors T12 and T13 to the negative side is further suppressed compared with that when the transistors T12 and T13 have an ON state for a long time, the reliability of the gate signal line driving circuit 22 is improved.

[Fourth Embodiment]

A display device according to a fourth embodiment of the invention is an TPS liquid crystal display device 1, for example, and includes the gate signal line driving circuit 22 according to any one of the first to third embodiments. In addition, the configuration of the TFT substrate 12 of the liquid crystal display device 1 according to the present embodiment is the same as the block diagram shown in FIG. 2. Display dots are regularly arrayed in the display unit 27, and three display dots of a red display dot (R), a green display dot (G), and a blue display dot (B) are arrayed in order in the horizontal direction in FIG. 2. These three display dots form one pixel. In addition, the liquid crystal display device 1 according to the present embodiment performs image display by dot inversion driving. Here, the dot inversion driving is that the driver IC 21 supplies a voltage of a video signal to the pixel electrode 110 of each display dot so that the voltage sign of the video signal supplied to the pixel electrode 110 of the plural display dots of the display unit 27 shown in FIG. 2 is different between display dots adjacent to each other like a chessboard (or checkerboard pattern) in a certain 1 frame period $T_F$.

Figure 11:
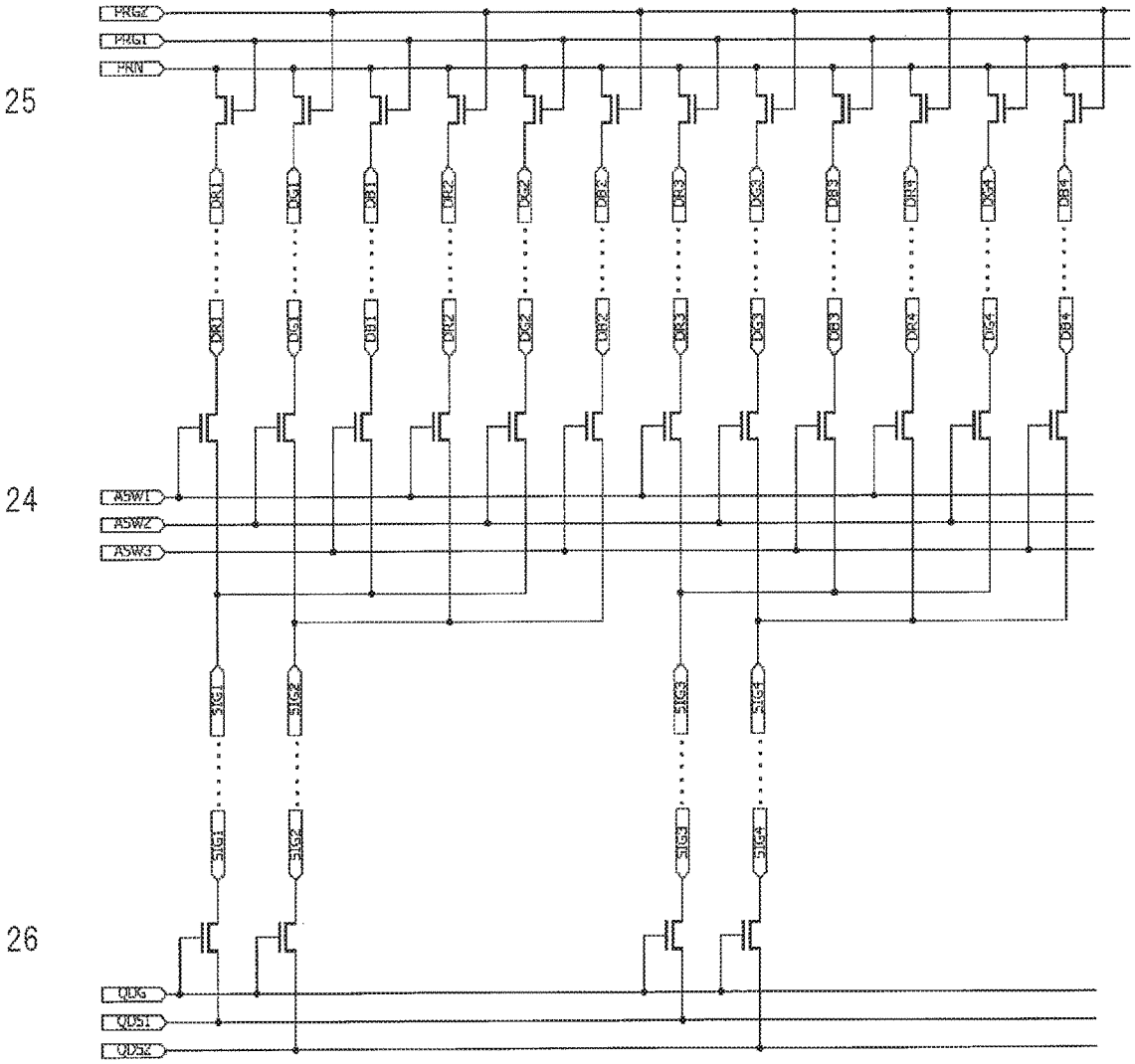
FIG. 11 is a schematic circuit diagram of a precharge circuit, an RGB selection circuit, and a detection circuit according to a fourth embodiment of the invention.

FIG. 11 is a schematic circuit diagram of the precharge circuit 25, the RGB selection circuit 24, and the detection circuit 26 according to the present embodiment.

As described above, the voltage of a video signal is supplied to each of the plural display dots of the display unit 27 by dot inversion driving. For example, pixels aligned horizontally in one row are assumed to be first, second, third, and fourth pixels in order from the left. As described above, in each pixel, three display dots of red, green, and blue colors are aligned in this order. Accordingly, the first pixel is formed by a first R display dot, a first G display dot, and a first B display dot, and this is the same for other pixels. In a certain frame period $T_F$, when the voltage sign of a video signal supplied from the driver IC 21 to the first R display dot is positive, the voltage sign of a video signal supplied to the first G display dot is negative by dot inversion driving. In this case, in order from the first R display dot and in the left direction, the signs of voltages of video signals are positive, negative, positive, and negative, which are alternately different.

The precharge circuit 25 includes plural switching elements (transistors) disposed corresponding to the plural video signal lines 107 (not shown). An odd-numbered precharge control line PRG1 is connected to a gate of an odd-numbered transistor from the left, and an even-numbered precharge control line PRG2 is connected to a gate of an even-numbered transistor from the left. In addition, a precharge voltage line PRN is connected to the input side of each switching element.

The output side of each switching element is connected to the corresponding video signal line 107. Accordingly, in the ON state, each switching element supplies the precharge voltage of the precharge voltage line PRN to the first R display dot, the first G display dot, the first B display dot, the second R display dot, the second G display dot, and the second B display dot, in order from the left. Since output-side terminals of switching elements are connected to the video signal lines 107 corresponding to the first R display dot, the first G display dot, the first B display dot, the output-side terminals of the switching elements are expressed as DR1, DG1, DB1, When the odd-numbered precharge control line PRG1 or the even-numbered precharge control line PRG2 has an ON voltage, the ON voltage is applied to gates of plural transistors connected thereto. Through the transistor in the ON state, the precharge voltage of the precharge voltage line PRN is supplied to the pixel electrode 110 of a corresponding display dot.

As described later, in the liquid crystal display device 1 according to the present embodiment, precharge driving is performed before a video signal is supplied for a display dot, in which the voltage sign of the supplied video signal is positive, among display dots which perform writing of video data in a high signal period (horizontal period H) of each gate signal. Therefore, the voltage of either the odd-numbered precharge control line PRG1 or the even-numbered precharge control line PRG2 becomes an ON voltage corresponding to the pixel electrode 110 of a display dot in which the voltage sign of a video signal becomes positive at the start of a high signal period (horizontal period H) of each gate signal, that is, according to the start of the high signal period. Then, the ON voltage is applied to the gates of the plural corresponding transistors. Through the transistor in the ON state, a precharge voltage of the precharge voltage line PRN is supplied to the pixel electrode 110 of the corresponding display dot. The precharge voltage is a much lower voltage than the minimum value of the voltage of a video signal supplied to the corresponding video signal line 107. In addition, the minimum value of the voltage of the video signal is a voltage when the sign of the voltage of the video signal is negative and the absolute value of the voltage of the video signal with respect to the reference voltage becomes a maximum.

The RGB selection circuit 24 includes plural switching elements (transistors) disposed corresponding to the plural video signal lines 107. Using two pixels (six display dots) as one set, a first switch control line ASW1 is connected to gates of first and fourth transistors (for red display dots) from the left, a second switch control line ASW2 is connected to gates of second and fifth transistors (for green display dots), and a third switch control line ASW3 is connected to gates of third and sixth transistors (for blue display dots). In addition, a first data voltage supply line SIG1 (odd-numbered data voltage supply line) is connected to the input sides of the first, third, and fifth (odd-numbered) transistors, and a second data voltage supply line SIG2

(even-numbered data voltage supply line) is connected to the input sides of the second, fourth, and sixth (even-numbered) transistors.

In the 1 frame period $T_F$, a high signal period (horizontal period H) of a gate signal output from the gate signal line driving circuit 22 to the corresponding gate signal line 105 is a period for which the video data is written into each of pixels which are aligned in one row and are connected to the corresponding gate signal line 105. During one horizontal period H, the first switch control line ASW1, the second switch control line ASW2, and the third switch control line ASW3 have an ON voltage in order, and the video data is written sequentially in corresponding display dots through the transistors in the ON state.

As described above, the liquid crystal display device 1 according to the present embodiment performs dot inversion driving. Accordingly, the voltage signs of video signals supplied to adjacent display dots are different. For example, the voltage sign of a video signal supplied to each display dot of the first pixel is positive, negative, and positive in order of the first R display dot, the first G display dot, and the first B display dot. Display dots in which the voltage signs of video signals are positive during a certain 1 horizontal period H are assumed to be a first R display dot, a first B display dot, and a second G display dot. In addition, these display dots are assumed to be odd-numbered display dots. On the other hand, display dots in which the voltage signs of video signals are negative during this 1 horizontal period H are assumed to be a first G display dot, a second R display dot, and a second B display dot, and these display dots are assumed to be even-numbered display dots.

Among display dots of the first and second pixels, three odd-numbered display dots are connected to the first data voltage supply line SIG1, which is an odd-numbered data voltage supply line, through a corresponding transistor and three even-numbered display dots are connected to the second data voltage supply line SIG2, which is an even-numbered data voltage supply line, through a corresponding transistor.

Since the RGB selection circuit 24 has such a configuration, the voltage signs of video signals supplied from each data voltage supply line to three display dots, which write video data in each horizontal period H, are the same. Accordingly, the load on the driver IC 21 when supplying the video signals to the three display dots in each horizontal period H is reduced.

The detection circuit 26 includes plural switching elements (transistors) disposed corresponding to plural data voltage supply lines. A switching element connected to the odd-numbered data voltage supply line is assumed to be an odd-numbered switching element (odd-numbered transistor), and a switching element connected to the even-numbered data voltage supply line is assumed to be an even-numbered switching element (even-numbered transistor). A first detection voltage supply line QDS1 (odd-numbered detection voltage supply line) is connected to the input side of an odd-numbered transistor (odd-numbered transistor) from the left, and a second detection voltage supply line QDS2 (even-numbered detection voltage supply line) is connected to the input side of an even-numbered transistor (even-numbered transistor) from the left. In addition, a detection control line QDG is connected to a gate of each switching element.

The detection circuit 26 is used for performance test of the TFT substrate 12 or for detection of the yield of the TFT substrate 12 after manufacturing the TFT substrate 12 of the liquid crystal display device 1 according to the present embodiment. When performing such detection test, a control signal is output to the gate signal line driving circuit 22 so as to perform forward driving, for example. The gate signal line driving circuit 22 outputs a gate signal in a high signal period in order of the forward direction. During each horizontal period H, an ON voltage is supplied to the detection control line QDG to turn on each switching element of the detection circuit 26. In addition, a detection voltage (for example, a voltage of video data of the maximum gradation value) for the corresponding display dot is supplied to each of the first and second detection voltage supply lines QDS1 and QDS2. Then, the detection voltage is supplied to the pixel electrode 110 of the corresponding display dot through each switching element in the ON state.

In this case, the first switch control line ASW1, the second switch control line ASW2, and the third switch control line ASW3 have an ON voltage in order during each horizontal period H, such that the detection voltage is applied to the three corresponding display dots through each data voltage supply line in each horizontal period H. Accordingly, the detection voltage is supplied to the pixel electrodes 110 of the corresponding display dots in order through plural transistors of the RGB selection circuit 24 in the ON state.

Since the liquid crystal display device 1 performs image display by dot inversion driving as described above, all signs of detection voltages which are supplied to three display dots through each data voltage supply line during each horizontal period H become equal by making the detection circuit 26 and the RGB selection circuit 24 have the above-described configuration. As a result, the detection voltage is supplied to the three display dots in each horizontal period H.

Figure 12:
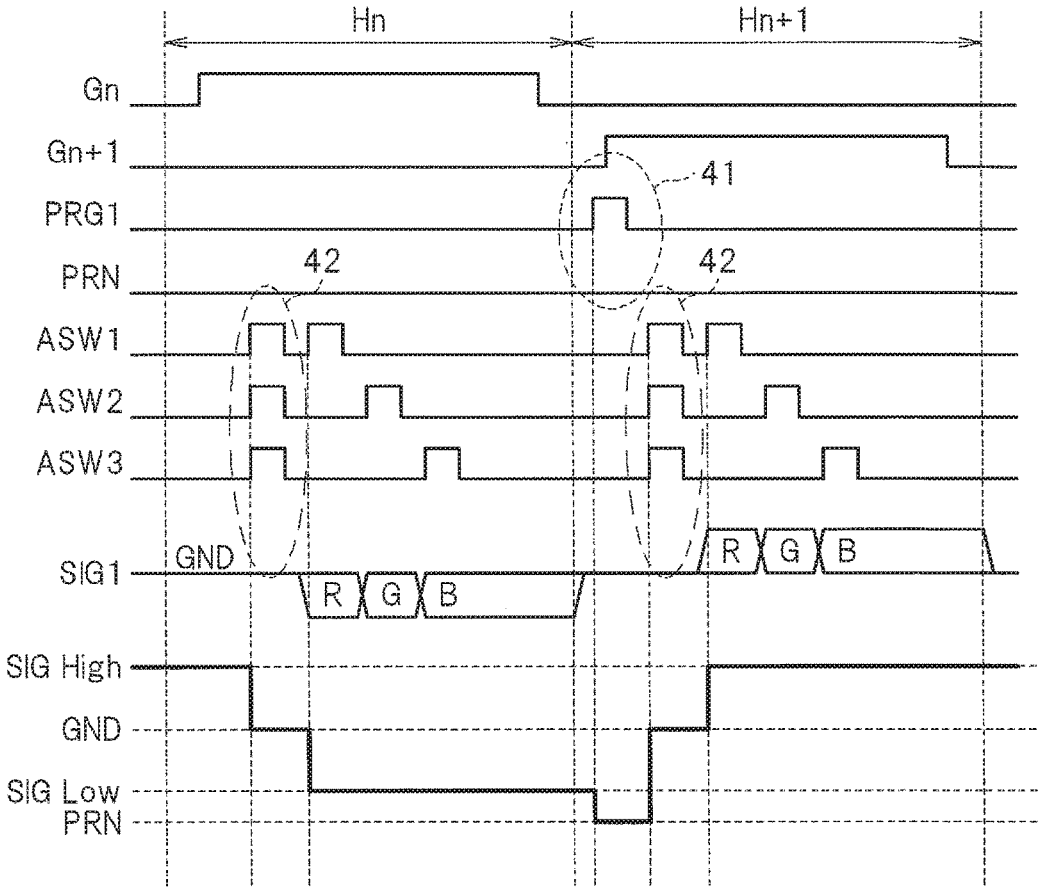
FIG. 12 is a view showing the driving of the precharge circuit and the RGB selection circuit according to the fourth embodiment of the invention.

FIG. 12 is a view showing the driving of the precharge circuit 25 and the RGB selection circuit 24 according to the present embodiment. In FIG. 12, the n-th and (n+1)-th gate signals $G_n$ and $G_{n+1}$, the odd-numbered precharge control line PRG1, the precharge voltage line PRN, the first to third switch control lines ASW1, ASW2, and ASW3, a voltage of a video signal supplied to the first data voltage supply line SIG1, and a voltage applied to the video signal line 107 connected to the first R display dot among the three video signal lines 107 connected to the first data voltage supply line SIG1 are shown with the elapse of time.

The driving characteristic of the liquid crystal display device 1 according to the present embodiment is that precharge driving is performed for a display dot, in which the voltage sign of a video signal becomes positive, before the video signal is supplied. In FIG. 12, this precharge driving is shown as PRN precharge driving 41.

In a certain frame period $T_F$, in first and second pixels aligned in the n-th row in order of a forward direction, all signs of voltages of video signals supplied to the first R display dot, the first B display dot, and the second G display dot connected to the first data voltage supply line SIG1 are negative, and all signs of voltages of video signals supplied to the first R display dot, the first B display dot, and the second G display dot aligned in the (n+1)-th row are positive. Accordingly, the voltage sign of a video signal supplied to the first data voltage supply line SIG1 is negative in a horizontal period $H_n$, which is shown at the left side in FIG. 12 and is a period for which the n-th gate signal $G_n$ is high, and is positive in a horizontal period $H_{n+1}$, which is shown at the right side in FIG. 12 and is a period for which the (n+1)-th gate signal $G_{n+1}$ is high voltage.

Accordingly, in the horizontal period $H_n$, the voltage sign of the video signal supplied to the first data voltage supply line SIG1 is negative, and the odd-numbered precharge control line PRG1 maintains an OFF voltage. Then, in the horizontal period $H_{n+1}$, the voltage sign of the video signal is positive. At the start of the horizontal period $H_{n+1}$ (at a timing corresponding to the start of the horizontal period $H_{n+1}$), the odd-numbered precharge control line PRG1 has an ON voltage.

In FIG. 12, the precharge driving is shown as the PRN precharge driving 41, and the odd-numbered precharge control line PRG1 has an ON voltage at the start of the horizontal period $H_{n+1}$. On the other hand, at the start of the horizontal period $H_n$, the even-numbered precharge control line PRG2 has an ON voltage. Accordingly, during the horizontal period $H_{n+1}$, the even-numbered precharge control line PRG2 maintains an OFF voltage.

As described above, the precharge voltage applied to the precharge voltage line PRN is a much lower voltage than the minimum value of the voltage of a video signal supplied to the video signal line 107. When the odd-numbered precharge control line PRG1 has an ON voltage, an odd-numbered transistor from the left in FIG. 11 is turned on. Through the transistor in the ON state, the precharge voltage of the precharge voltage line PRN is applied to the corresponding video signal line 107. Here, in the first and second pixels, the precharge voltage is applied to the video signal line 107 connected to the pixel electrode 110 of the first R display dot, the first B display dot, and the second G display dot.

Then, GND precharge driving 42 is performed. Since the liquid crystal display device 1 according to the present embodiment performs dot inversion driving to perform display, the voltage signs of video signals supplied to the pixel electrodes 110 of adjacent display dots are different. Moreover, when the voltage sign of the video signal supplied to the pixel electrode 110 of a certain display dot is negative (positive) in a certain horizontal period II, the voltage sign of the video signal supplied to the pixel electrode 110 of the display dot in a subsequent horizontal period H is positive (negative). If the voltage applied to the video signal line 107 connected to the display dot is changed from negative to positive (from positive to negative) by the driver IC 21, the load on the driver IC 21 becomes large.

Accordingly, the GND precharge driving 42 is performed for all display dots in one row connected to the gate signal line 105 with a high-voltage gate signal, and the voltages of the plural video signal lines 107 and the pixel electrode 110 of display dots in the corresponding row are changed to the ground voltage GND. Specifically, the driver IC 21 makes all of the first to third switch control lines ASW1, ASW2, and ASW3 have an ON voltage, and supplies the ground voltage GND to all of the plural data voltage supply lines.

In this case, it is assumed that the GND precharge driving 42 is performed in each horizontal period H unlike the PRN precharge driving 41. In FIG. 12, the GND precharge driving 42 is shown. In addition, in the previous horizontal period H, the signs of voltages supplied to the adjacent video signal lines 107 are different. Accordingly, by performing the GND precharge driving 42, the load on the driver IC 21 when setting the plural video signal lines 107 to have the ground voltage GND is reduced.

After performing the GND precharge driving 42, the video data is written in each display dot. As described above, the first switch control line ASW1, the second switch control line ASW2, and the third switch control line ASW3 have an ON voltage in order, and the video data is written in corresponding display dots through the transistors in the ON state. Here, the video data is written in odd-numbered display dots of the first and second pixels through the first data voltage supply line SIG1. The voltage of a video signal is applied to the pixel electrode 110 through the first data voltage supply line SIG1 in order of the first R display dot, the second G display dot, and the first B display dot. FIG. 12 shows a video signal supplied to the first data voltage supply line SIG1. During the horizontal period $H_n$, the voltage sign of a video signal supplied to three corresponding display dots is negative. During the horizontal period $H_{n+1}$, the voltage sign of a video signal supplied to three corresponding display dots is positive.

In addition, the video data is written in even-numbered display dots through the second data voltage supply line SIG2. Accordingly, the voltage sign of the video signal supplied to the second data voltage supply line SIG2 is always different from the voltage sign of the video signal supplied to the first data voltage supply line SIG1. Moreover, in each horizontal period H, the voltage of a video signal is applied to the pixel electrode 110 in order of the second R display dot, the first G display dot, and the second B display dot.

The voltage applied to the video signal line 107 of the first R display dot connected to the first data voltage supply line STG1 is schematically shown at the bottom in FIG. 12. Hereinafter, for the sake of simplicity, the voltage applied to the video signal line 107 of the first R display dot connected to the first data voltage supply line SIG1 is simply written as a voltage applied to the video signal line 107.

In a horizontal period $H_{n-1}$ (not shown) for which the (n−1)-th gate signal $G_{n-1}$ has a high voltage, the voltage of a video signal is supplied to odd-numbered display dots of the first and second pixels aligned in the (n−1)-th row through the first data voltage supply line SIG1, and the sign of the corresponding voltage is positive. Accordingly, the sign of the voltage applied to the video signal line 107 is positive.

In the horizontal period $H_n$, the voltage sign of a video signal supplied to odd-numbered display dots aligned in the n-th row is negative. Therefore, since the PRN precharge driving 41 is not performed for the corresponding display dots, the voltage applied to the video signal line 107 is a voltage of a video signal of odd-numbered display dots aligned in the (n−1)-th row as shown in FIG. 12, and is shown as a positive voltage SIG High.

Then, the GND precharge driving 42 is performed. As a result, the voltage applied to the first data voltage supply line SIG1 and the connected three video signal lines 107 becomes the ground voltage GND. In addition, the video data is written in each display dot, but the voltage sign of the video signal supplied to odd-numbered display dots aligned in the n-th row is negative. Accordingly, as shown in FIG. 12, the voltage applied to the video signal line 107 is a voltage of a video signal of odd-numbered display dots aligned in the n-th line and is shown as a negative voltage SIG Low.

In the horizontal period $H_{n+1}$, the voltage sign of a video signal supplied to odd-numbered display dots aligned in the (n+1)-th row is positive. Accordingly, the PRN precharge driving 41 is performed for the corresponding display dots. As shown in FIG. 12, the voltage applied to the video signal line 107 is a precharge voltage of the precharge voltage line PRN and is shown as PRN.

Then, similar to the horizontal period $H_n$, the voltage applied to the first data voltage supply line SIG1 and the connected video signal line 107 becomes the ground voltage GND by the GND precharge driving 42. In addition, by writing the video data in the corresponding display dots, the voltage applied to the video signal line 107 is shown in FIG. 12 as a positive voltage SIG High.

In the above, driving of the liquid crystal display device 1 according to the present embodiment has been described. In the case where the display device performs display using a dot inversion method, the voltage sign of a video signal applied to the video signal line 107 in each horizontal period H of the 1 frame period $T_F$ changes. That is, the sign of the voltage applied to the video signal line 107 changes to repeat positive and negative signs. Between the video signal line 107 and the common signal line 108, there is capacitive coupling. Accordingly, as the voltage applied to the video signal line 107 changes, the reference voltage applied to the common signal line 108 (common electrode 111) changes due to the capacitive coupling.

A change of the common signal line 108 occurring when the voltage applied to the video signal line 107 changes in the negative direction and a change of the common signal line 108 occurring when the voltage applied to the video signal line 107 changes in the positive direction are assumed to be the same and symmetrical. In this case, in the 1 frame period $T_F$, the voltage applied to the video signal line 107 changes from negative to positive (in the positive direction) in a certain horizontal period H and then changes from positive to negative (in the negative direction) in the next horizontal period H. Accordingly, it is thought that the influence of changes of the common signal line 108 is negated in the 1 frame period $T_F$. In addition, the signs of voltages applied to adjacent video signal lines are different. For this reason, in a certain horizontal period H, when the voltage applied to a certain video signal line 107 changes from negative to positive (in the positive direction), the voltage applied to an adjacent video signal line 107 changes from positive to negative (in the negative direction). Accordingly, it is thought that the influence of changes of the common signal line 108 is negated.

However, if the PRN precharge driving 41 is executed before writing in which the voltage sign of a video signal is negative, the common signal line 108 changes in the positive direction since the precharge voltage is lower than the minimum value of the voltage of a video signal. Accordingly, even at the time of writing in which the voltage sign of a video signal is positive, the common signal line 108 changes in the positive direction. As a result, the influence of changes of the common signal line 108 is not negated.

The inventors have found out through the study that it is possible to negate the influence of changes of the common signal line 108 by executing the PRN precharge driving 41 before the writing, in which the voltage sign of a video signal is positive, after the writing in which the voltage sign of a video signal is negative. Accordingly, driving shown in FIG. 12 is adopted as driving of the liquid crystal display device 1 according to the present embodiment.

As described above, the driving characteristic of the liquid crystal display device 1 according to the present embodiment is that the PRN precharge driving 41 is performed for a display dot, in which the voltage sign of a video signal becomes positive, before the video signal is supplied. As shown in FIG. 12, the voltage applied to the video signal line 107 is dropped to the precharge voltage of the precharge voltage line PRN, which is much lower than the voltage (negative voltage) of video signals of display dots in the n-th row, by performing the PRN precharge driving 41, so that the voltage applied to the video signal line 107 changes in the negative direction. In this case, the common signal line 108 changes in the negative direction by capacitive coupling. Then, the voltage applied to the video signal line 107 is changed in the positive direction as usual. In this case, the common signal line 108 changes in the positive direction by capacitive coupling. By the PRN precharge driving 41, the influence of changes of the common signal line 108 caused when the voltage applied to the video signal line 107 changes from negative to positive can be weakened. As a result, since the influence of changes of the common signal line 108 is negated by different changes of a certain video signal line 107 in adjacent horizontal periods H or by different changes of adjacent video signal lines 107 in the same horizontal period H, abnormal display is suppressed.

[Fifth Embodiment]

A display device according to a fifth embodiment of the invention has basically the same configuration as the display device 1 according to the fourth embodiment. A difference between the liquid crystal display device 1 according to the present embodiment and the liquid crystal display device 1 according to the fourth embodiment is the structure of the precharge circuit 25, the RGB selection circuit 24, and the detection circuit 26.

Figure 13:
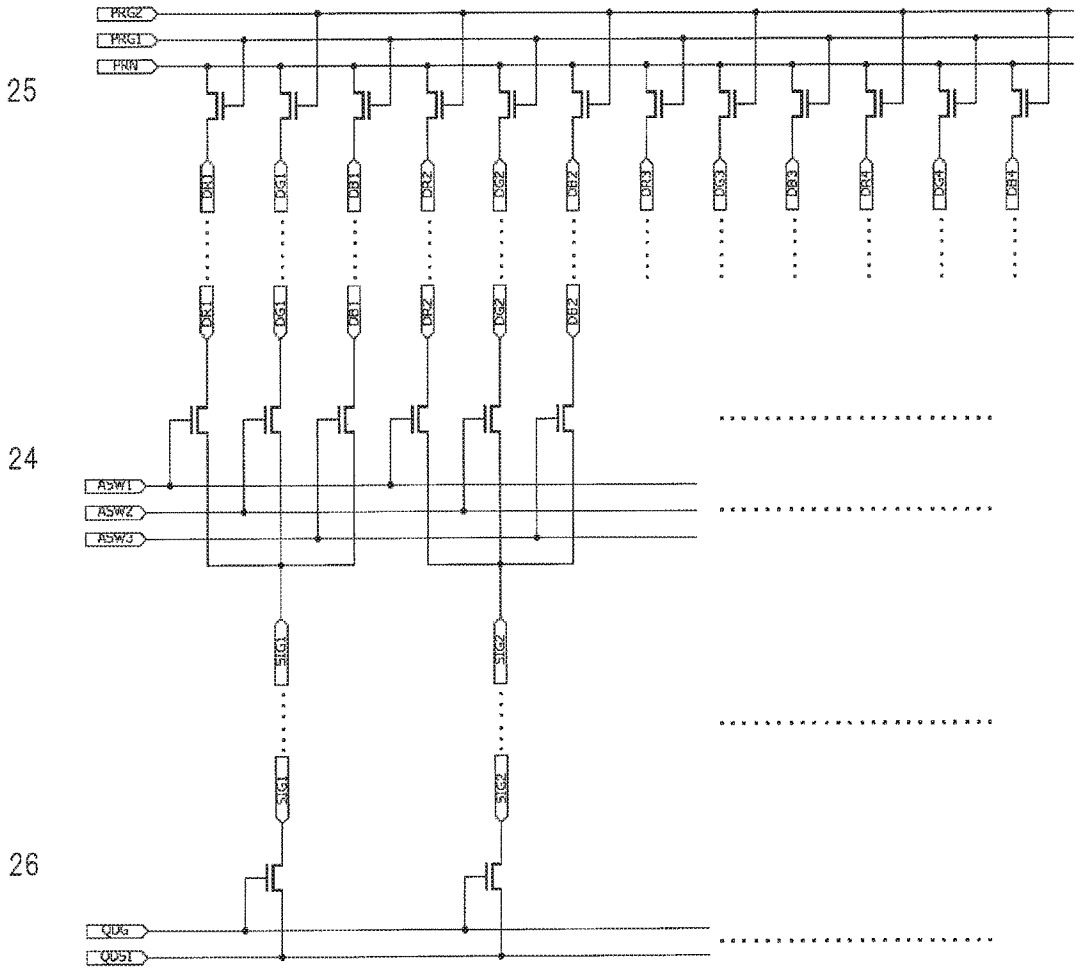
FIG. 13 is a schematic circuit diagram of a precharge circuit, an RGB selection circuit, and a detection circuit in an example of a fifth embodiment of the invention.

FIG. 13 is a schematic circuit diagram of the precharge circuit 25, the RGB selection circuit 24, and the detection circuit 26 in an example of the present embodiment.

In the RGB selection circuit 24 according to the fourth embodiment shown in FIG. 11, plural switching elements (transistors) are disposed such that in two pixels, three odd-numbered display dots and the first data voltage supply line SIG1 (odd-numbered data voltage supply line) are connected to each other and three even-numbered display dots and the second data voltage supply line SIG2 (even-numbered data voltage supply line) are connected to each other. On the other hand, in the RGB selection circuit 24 according to the present embodiment, plural switching elements (transistors) corresponding to each pixel are disposed so that three display dots of each pixel are connected to each data voltage supply line. That is, for example, three display dots (the first R display dot, the first G display dot, and the first B display dot) of the first pixel are connected to the first data voltage supply line SIG1.

As described above, in a certain horizontal period H, the voltage signs of video signals, which are supplied from the driver IC 21 to two adjacent display dots of three display dots connected to each data voltage supply line are different. Also in such a case, when there is a sufficient driving capability in the driver IC 21, the circuit size can be reduced by using the RGB selection circuit 24 shown in FIG. 13.

The detection circuit 26 according to the present embodiment shown in FIG. 11 includes plural switching elements (transistors), which are disposed corresponding to each of plural data voltage supply lines, corresponding to the RGB selection circuit 24 according to the present embodiment. When performing a performance test of the liquid crystal display device 1 or detecting the yield of the liquid crystal display device 1, detection voltages are sequentially supplied to the pixel electrodes 110 of corresponding three display dots through each data voltage supply line when the first to third switch control lines ASW1, ASW2, and ASW3 have an ON voltage in order during each horizontal period H. In this case, the signs of the detection voltages supplied to two adjacent display dots of the three corresponding display dots are different.

Also in this case, abnormal display is suppressed by performing the PRN precharge driving 41 for a display dot, in which the voltage of a supplied video signal becomes positive, before the video signal is supplied, similar to the driving in the fourth embodiment shown in FIG. 12.

Figure 14:
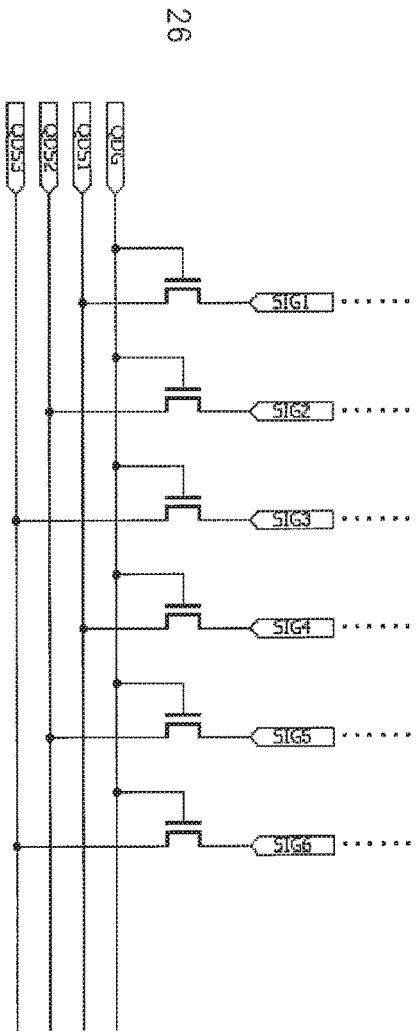
FIG. 14 is a schematic circuit diagram of the detection circuit in another example of the fifth embodiment of the invention.

FIG. 14 is a schematic circuit diagram of the detection circuit 26 in another example of the present embodiment. Unlike the case shown in FIG. 13, the RGB selection circuit 24 and the precharge circuit 25 are provided in the driver IC 21, and the voltage of a video signal is directly supplied from the driver IC 21 to the video signal line 107.

The detection circuit 26 is disposed every video signal line 107 connected to plural display dots aligned in each row. Each of three display dots of each pixel and a switching element (transistor) are connected to each other through the corresponding video signal line 107. The detection control line QDG is connected to a switch (gate) of each switching element (transistor). In addition, the first detection voltage supply line QDS1, the second detection voltage supply line QDS2, and the third detection voltage supply line QDS3 are connected to the input sides of plural switching elements (transistors) in order of red, green, and blue.

Also in this case, abnormal display is similarly suppressed by performing the PRN precharge driving 41 for a display dot, in which the voltage sign of a supplied video signal becomes positive, through the video signal line 107 before the video signal is supplied to the corresponding video signal line 107.

[Sixth Embodiment]

A display device according to a sixth embodiment of the invention has basically the same configuration as the display device according to the fourth embodiment. The liquid crystal display device 1 according to the fourth embodiment performs image display by dot inversion driving, while the liquid crystal display device 1 according to the present embodiment performs image display by line inversion driving.

Here, the line inversion driving refers to driving in which the voltage signs of video signals supplied to plural display dots provided in the display unit 27 are different between display dots adjacent to each other in the vertical direction shown in FIG. 3 and are the same in the horizontal direction, for example.

Unlike the TFT substrate 12 shown in FIG. 2, the TFT substrate 12 according to the present embodiment includes an equalizing circuit 35 instead of the precharge circuit 25.

Figure 15:
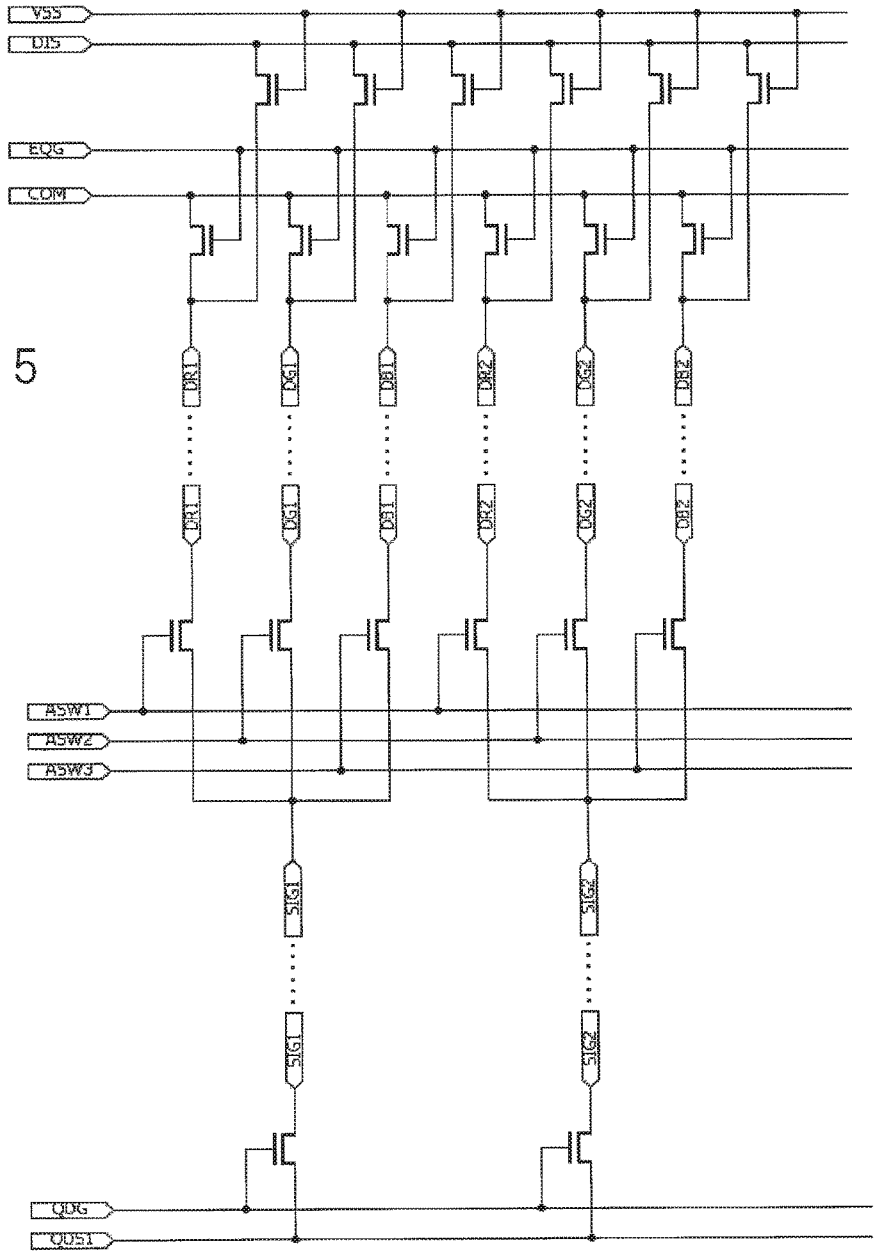
FIG. 15 is a schematic circuit diagram of an equalizing circuit, an RGB selection circuit, and a detection circuit according to a sixth embodiment of the invention.

FIG. 15 is a schematic circuit diagram of the equalizing circuit 35, the RGB selection circuit 24, and the detection circuit 26 according to the present embodiment.

The equalizing circuit 35 includes plural transistor elements (transistors), and two switching elements (transistors) disposed in parallel are disposed for each video signal line 107 (not shown). An equalizing control line EQG is connected to a gate of one transistor, and a reference voltage COM supplied to the common signal line 108 is input to the input side. A discharge control line VSS is connected to a gate of the other transistor, and a discharge voltage line DIS is connected to the input side.

When the equalizing control line EQG has an ON voltage, the reference voltage COM supplied to the common signal line 108 is applied to the plural video signal lines 107 through the transistors in the ON state. Then, equalizing driving 43 is performed as will be described later.

In addition, the discharge control line VSS always has an OFF voltage at the time of driving of the liquid crystal display device 1, but changes to an ON voltage when a supply source of the liquid crystal display 1, such as a battery, is detached. Accordingly, the voltage of the discharge voltage line DIS is applied to the plural video signal lines 107 through the transistors in the ON state. The voltage of the discharge voltage line DIS is the ground voltage GND, for example. Then, discharge driving is performed to discharge electric charges collected in the display unit 27 of the liquid crystal display device 1.

Assuming that display dots aligned in one row in the horizontal direction are the first R display dot, the first G display dot, the first B display dot, the second R display dot, the second G display dot, and the second B display dot in order from the left, the output side of each switching element is connected to the corresponding video signal line 107. In FIG. 15, DR1, DG1, DB1, are shown in order from the left as in the precharge circuit 25 shown in FIG. 11. In addition, the RGB selection circuit 24 and the detection circuit 26 shown in FIG. 15 have the same configuration as the RGB selection circuit 24 and the detection circuit 26 shown in FIG. 13.

Figure 16:
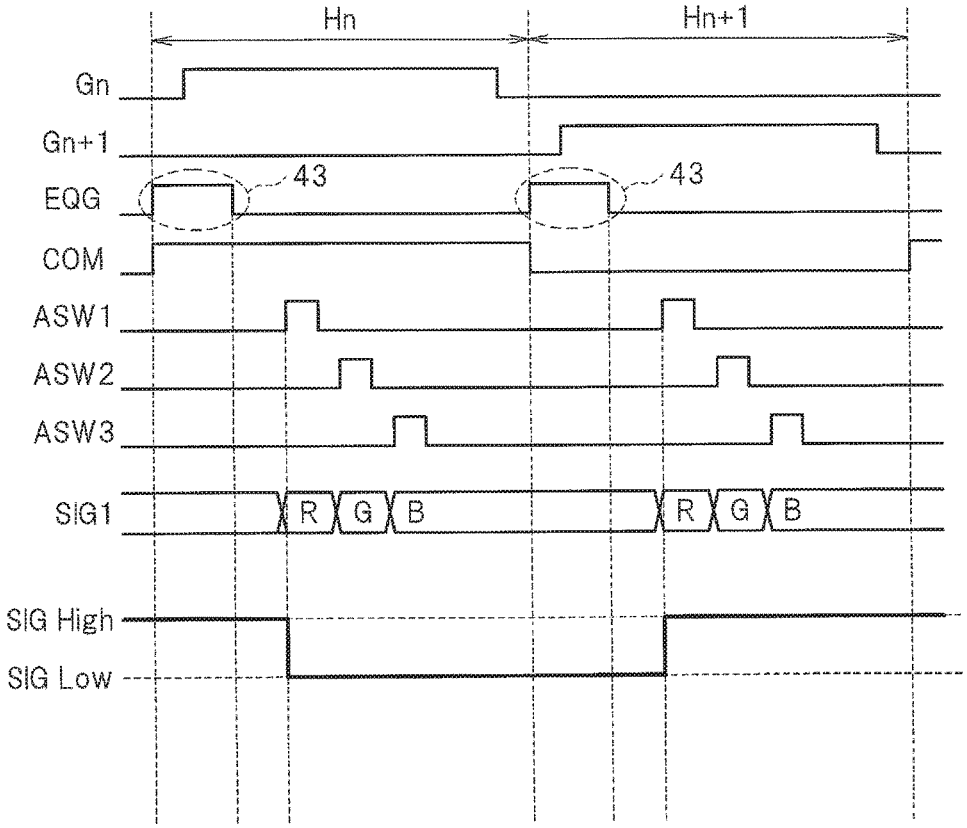
FIG. 16 is a view showing the driving of the equalizing circuit and the RGB selection circuit according to the sixth embodiment of the invention.

FIG. 16 is a view showing the driving of the equalizing circuit 35 and the RGB selection circuit 24 according to the present embodiment. In FIG. 16, the n-th and (n+1)-th gate signals $G_n$ and $G_{n+1}$, the equalizing control line EQG, the reference voltage COM, the first to third switch control lines ASW1, ASW2, and ASW3, a voltage of a video signal supplied to the first data voltage supply line SIG1, and a voltage applied to the video signal line 107 connected to the first R display dot among the three video signal lines 107 connected to the first data voltage supply line SIG1 are shown with the elapse of time.

The characteristic of the driving of the liquid crystal display device 1 according to the present embodiment is that equalizing driving is performed at the start of each horizontal period H. In FIG. 16, the equalizing driving 43 is shown. As described above, there is capacitive coupling between the video signal line 107 and the common signal line 108. Accordingly, as the voltage of the common signal line 108 changes, the voltage applied to the video signal line 107 changes due to the capacitive coupling. The equalizing driving 43 refers to driving for short-circuiting the video signal line 107 and the common signal line 108 to each other. Through the equalizing driving 43, a change of the video signal line 107 caused by voltage changes of the common signal line 108 can be suppressed.

As described above, the equalizing driving 43 is performed at the start of each horizontal period H. Accordingly, both at the start of the horizontal period $H_n$ and at the start of the horizontal period $H_{n+1}$, the equalizing control line EQG has an ON voltage, so that the equalizing driving 43 is performed.

At the start of the horizontal period $H_n$, the reference voltage COM supplied to the common signal line 108 changes from the negative voltage to the positive voltage. Accordingly, if the equalizing driving 43 is not performed, the voltage applied to the video signal line 107 changes in the positive direction due to capacitive coupling. As a result, the voltage applied to the video signal line 107 is changed to the positive reference voltage COM by the equalizing driving 43. FIG. 15 shows, for the sake of, simplicity, a case where the voltage of a video signal, which is a positive voltage, and the reference voltage COM, which is a positive voltage, are equal, and the voltage applied to the video signal line 107 is fixed accordingly.

After the equalizing driving 43, the video data is written in each display dot similar to the driving shown in FIG. 12. That is, as described above, the first switch control line ASW1, the second switch control line ASW2, and the third switch control line ASW3 have an ON voltage in order, and the video data is written in corresponding display dots through the transistors in the ON state.

At the start of the horizontal period $H_{n+1}$, the reference voltage COM changes from the positive voltage to the negative voltage. Accordingly, if the equalizing driving 43 is not performed, the voltage applied to the video signal line 107 changes in the negative direction due to capacitive coupling. As a result, the voltage applied to the video signal line 107 is changed to the negative reference voltage COM by the equalizing driving 43. After the equalizing driving 43, the video data is similarly written in each display dot.

In the liquid crystal display device 1 according to the present embodiment, the RGB selection circuit 24 and the equalizing circuit 35 may be provided in the driver IC 21 as in FIG. 14.

Figure 17:
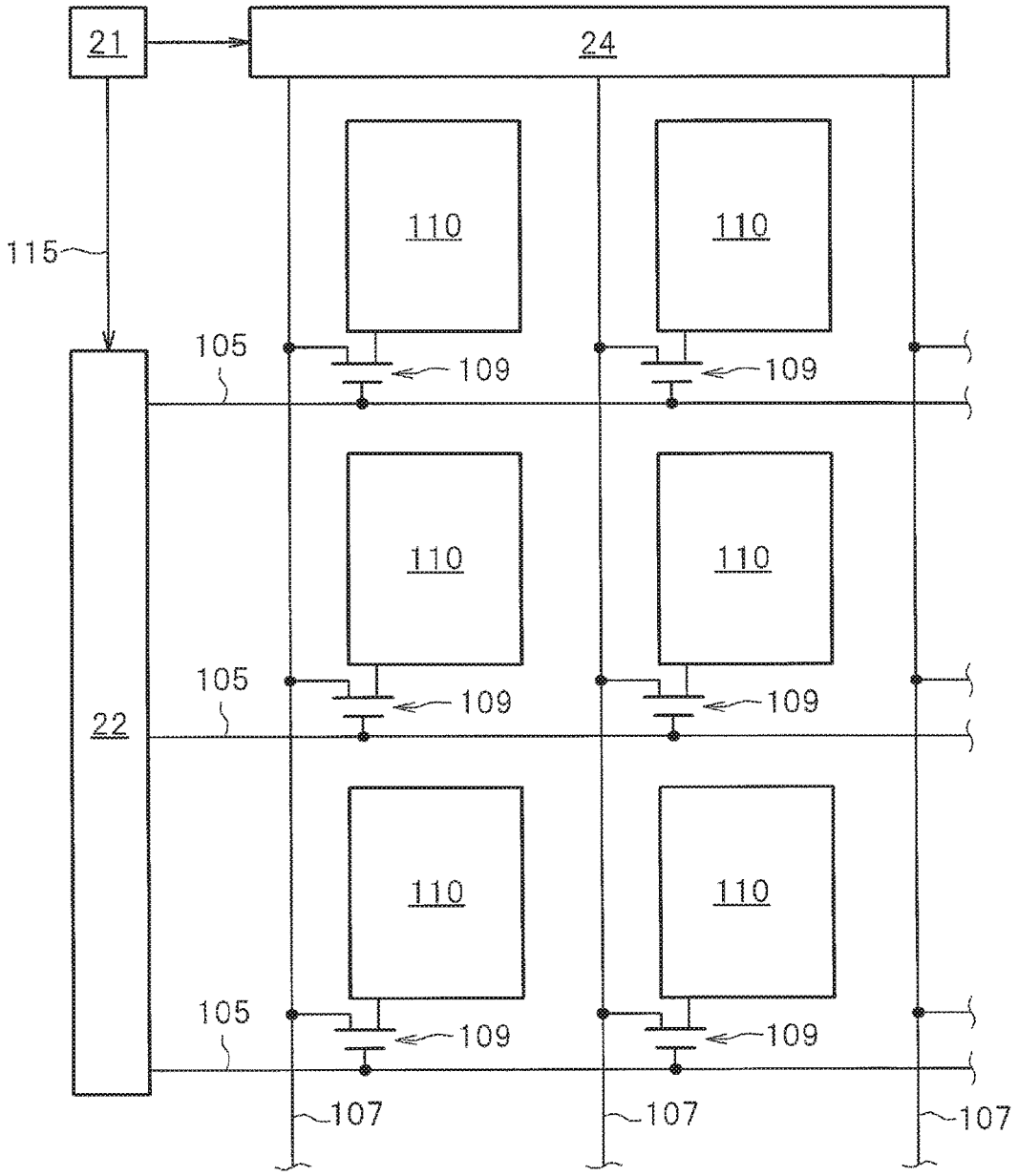
FIG. 17 is a conceptual view of an equivalent circuit of main parts of a TFT substrate provided in another liquid crystal display device according to the embodiment of the invention.

As the display devices according to the embodiments of the invention, the IPS liquid crystal display device has been described in the above as shown in FIG. 2. However, the display device according to the invention may be other liquid crystal display devices, such as a VA (Vertically Aligned) liquid crystal display device and a TN (Twisted Nematic) liquid crystal display device, or may be other display devices, such as an organic EL display device. FIG. 17 is a conceptual view of an equivalent circuit of the TFT substrate 12 provided in the VA liquid crystal display device and the TN liquid crystal display device. In this case, the common electrode 111 is provided on the filter substrate 11 facing the TFT substrate 12.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A shift register circuit comprising:

a plurality of shift register basic circuits each outputting a high voltage and a low voltage to an output line; and a first clock signal line applying a first clock signal to the plurality of shift register basic circuits, wherein each of the shift register basic circuits includes:

a first transistor applying the high voltage of the first clock signal to the output line when in an ON state;

a second transistor applying the low voltage to the output line when in an ON state;

a third transistor applying the low voltage to the output line when in an ON state in at least a part of a period until the second transistor is turned on after the first transistor is turned off;

a fourth transistor applying an OFF voltage to a control electrode of the second transistor when in an ON state; and a fifth transistor applying an ON voltage to a control electrode of the second transistor when in an ON state, wherein a common ON control signal is supplied from a previous shift register basic circuit to both a control electrode of the fourth transistor and a control electrode of the first transistor, and both the fourth transistor and the first transistor are turned on by the common ON control signal, and wherein the control electrode of the fifth transistor is electrically connected to the first clock signal line, and the control electrode of the first transistor and the control electrode of the fourth transistor are electrically connected by a voltage buffer circuit.

2. The shift register circuit according to claim 1, wherein an output signal of a subsequent stage is input to a control electrode of the third transistor of each of the shift register basic circuits.

3. The shift register circuit according to claim 1, wherein each of the shift register basic circuits further comprises a sixth transistor applying an OFF voltage to a control electrode of the fourth transistor.

4. The shift register circuit according to claim 1, wherein the voltage buffer circuit is two transistors which are connected in series and control electrodes of the two transistors are connected each other.

5. A shift register circuit comprising:

a plurality of shift register basic circuits each of which outputs a high voltage and a low voltage to an output line; and a first clock signal line applying a first clock signal to the plurality of shift register basic circuits, wherein each of the shift register basic circuits comprises:

a first transistor applying the high voltage to the output line when in an ON state;

a second transistor applying the low voltage to the output line when in an ON state;

a third transistor applying the low voltage to the output line when in an ON state in at least a part of a period until the second transistor is turned on after the first transistor is turned off;

a fourth transistor applying an OFF voltage to a control electrode of the second transistor when in an ON state; and a fifth transistor applying an ON voltage to a control electrode of the second transistor when in an ON state, wherein a common ON control signal which is output from a previous stage of the shift register basic circuit is supplied to both a control electrode of the fourth transistor and a control electrode of the first transistor, wherein the fourth transistor and the first transistor are turned on by the common ON control signal, and the control electrode of the fifth transistor is electrically connected to the first clock signal line applying the ON voltage, and wherein the control electrode of the first transistor and the control electrode of the fourth transistor are electrically connected by two voltage buffer transistors which are connected in series.

6. The shift register circuit according to claim 5, wherein an output signal of a subsequent stage is input to a control electrode of the third transistor of each of the shift register basic circuits.

7. The shift register circuit according to claim 5, wherein each of the shift register basic circuits further comprises a sixth transistor applying an OFF voltage to a control electrode of the fourth transistor.

8. The shift register circuit according to claim 5, wherein control electrodes of the two voltage buffer transistors are connected each other.

* * * * *